US005479948A

United States Patent [19]

Counts et al.

[11] Patent Number: 5,479,948

[45] Date of Patent: Jan. 2, 1996

[54] ELECTRICAL SMOKING ARTICLE HAVING CONTINUOUS TOBACCO FLAVOR WEB AND FLAVOR CASSETTE THEREFOR

[75] Inventors: Mary E. Counts; Willie G. Houck, Jr., both of Richmond; Kenneth S. Houghton, Midlothian; A. Clifton Lilly, Jr., Chesterfield; Peter J. Lipowicz; James L. Myracle, both of Midlothian; F. Murphy Sprinkel, Glen Allen; James M. Washington, Richmond; Susan E. Wrenn, Chesterfield, all of Va.

[73] Assignee: Philip Morris Incorporated, New York, N.Y.

[21] Appl. No.: 105,346

[22] Filed: Aug. 10, 1993

[51] Int. Cl.[6] ..... A24F 47/00

[52] U.S. Cl. ..... 131/194; 131/270; 131/273; 392/390

[58] Field of Search ..... 131/329, 194, 131/270–273; 128/202.21, 203.17, 203.27; 239/52; 392/390

[56] References Cited

U.S. PATENT DOCUMENTS

| | | | |
|---|---|---|---|
| 4,735,358 | 4/1988 | Morita et al. . | |
| 4,947,874 | 8/1990 | Brooks et al. | 131/194 |
| 4,947,875 | 8/1990 | Brooks et al. | 131/194 X |
| 5,060,671 | 10/1991 | Counts et al. . | |
| 5,095,921 | 3/1992 | Losee et al. . | |

FOREIGN PATENT DOCUMENTS

| | | | |
|---|---|---|---|
| 0438862A3 | 1/1984 | European Pat. Off. . | |
| 0503767A1 | 6/1985 | European Pat. Off. . | |
| 0313215A2 | 9/1988 | European Pat. Off. | A61L 9/12 |
| 0455463 | 11/1991 | European Pat. Off. . | |
| 0469814 | 2/1992 | European Pat. Off. . | |
| 2837040 | 2/1980 | Germany . | |
| 3735704A1 | 5/1989 | Germany . | |
| 2108390 | 5/1983 | United Kingdom . | |
| 2122903 | 1/1984 | United Kingdom . | |
| 2166957 | 5/1986 | United Kingdom . | |
| WO9013328 | 11/1990 | WIPO . | |
| WO9205824 | 4/1992 | WIPO . | |

OTHER PUBLICATIONS

Brochure: *Haynes Alloy No. 214,* Haynes International of Kokoomo, Ind., pp. 1–14, 1987.

*Primary Examiner*—Jennifer Bahr

*Attorney, Agent, or Firm*—Kevin B. Osborne; James E. Schardt; Charles E. B. Glenn

[57] ABSTRACT

An electrical smoking article is provided in which tobacco flavor medium is carried past a heater by a continuous web. The web, which preferably is substantially non-combustible, may bear continuous tobacco flavor medium or spaced-apart portions of tobacco flavor medium. A flavor cassette for such an electrical smoking article is also provided. The cassette resembles a conventional recording tape microcassette, having the web in place of magnetic tape. The cassette may also include the heater past which the tape is indexed to heat individual portions of tobacco flavor medium.

145 Claims, 12 Drawing Sheets

ELECTRICAL SMOKING ARTICLE HAVING CONTINUOUS TOBACCO FLAVOR WEB AND FLAVOR CASSETTE THEREFOR

BACKGROUND OF THE INVENTION

This invention relates to electrical smoking articles, and more particularly to electrical smoking articles having a continuous web containing a tobacco flavor medium, as well as to a replaceable cassette enclosing the continuous web.

One type of electrical smoking article is disclosed in commonly-assigned U.S. Pat. Nos. 5,060,671 and 5,095,921, which are hereby incorporated by reference in their entirety. In such an electrical smoking article, a flavor portion of a tobacco flavor medium, such as tobacco or tobacco-derived substances, is heated electrically to release a tobacco flavor substance. As the substance is heated, a smoker at the mouth or downstream end of the device draws air in and around the heating element by inhaling, and thereby receives the tobacco flavor substance.

The above-identified patents disclose a number of possible heater configurations, many of which are made from a carbon composite material formed into a desired shape. For example, one configuration involves a radial array of blades connected in common at the center and separately connectable at their outer edges to a source of electrical power. By depositing tobacco flavor medium on each blade and heating the blades individually, one could provide a predetermined number of discrete portions of tobacco flavor substance to the smoker. Other configurations included various linear and tubular shapes, subdivided to provide a number of discrete heating areas. Alternatively, semiconductor heaters, such as those described in copending, commonly-assigned United States patent application Ser. No. 07/943,505, filed Sep. 11, 1992 and hereby incorporated by reference in its entirety, can be used. Additional heater configurations are also disclosed in application Ser. No. 07/943,505, as well as in copending, commonly-assigned United States patent application Ser. No. 07/943,504, filed Sep. 11, 1992 and hereby incorporated by reference in its entirety.

Other configurations have been proposed. For example, various arrays of discrete fingers or blades of heater material can be provided, each blade providing one puff. However, suitable heater materials, such as those described in said above-incorporated U.S. Pat. No. 5,060,671, are generally not strong enough to be arranged in such a blade configuration without threat of blade breakage.

As disclosed in said above-incorporated U.S. Pat. No. 5,060,671, such heating elements are preferably disposable and replaceable. Therefore, they should be relatively inexpensive to produce. Further, there should be a way of easily applying tobacco flavor medium to the heating elements so that each activation of a heating element delivers one portion or "puff" of tobacco flavor substance to the smoker, while preventing reheating of any one portion of tobacco flavor medium.

In addition, the replaceable heater/flavor units heretofore described contain a limited number of individual charges of tobacco flavor medium, and thus provide a limited number of portions or puffs of tobacco flavor substance to the smoker. For example, a heater/flavor of the type described above might provide eight or ten puffs, to mimic a conventional cigarette. That requires the smoker to continually change heater/flavor units throughout a day of using the electrical smoking article. Each time the heater/flavor unit is changed, additional wearing of the contacts on the permanent portion of the article occurs. Also, each spent heater/flavor unit increases the volume of material disposed of.

It would be desirable to be able to provide an electrical smoking article in which the tobacco flavor medium is contained in a substantially continuous tobacco flavor web.

It would also be desirable to be able to provide a replaceable flavor or heater/flavor unit for such an electrical smoking article which can provide a relatively large number of flavor portions, to reduce the wear on the permanent portion of the article, to reduce the volume of material disposed of, and to increase the convenience for the smoker.

It would further be desirable to be able to provide a replaceable flavor or heater/flavor unit for such an electrical smoking article which can be manufactured easily and at relatively low cost.

SUMMARY OF THE INVENTION

It is an object of this invention to provide an electrical smoking article in which the tobacco flavor medium is contained in a substantially continuous tobacco flavor web.

It is also an object of this invention to provide a replaceable flavor or heater/flavor unit for such an electrical smoking article which can provide a relatively large number of flavor portions, to reduce the wear on the permanent portion of the article, to reduce the volume of material disposed of, and to increase the convenience for the smoker.

It is a further object of this invention to provide a replaceable flavor or heater/flavor unit for such an electrical smoking article which can be manufactured easily and at relatively low cost.

In accordance with this invention, there is provided an electrical smoking article having a source of electrical energy, an elongated web containing tobacco flavor medium, electrical heating means for heating tobacco flavor medium in thermal proximity thereto, puff sensor means for determining when a smoker puffs on the article, and control means responsive to the puff sensor means for applying electrical energy from the source of electrical energy to the electrical heating means to generate a tobacco flavor substance from the tobacco flavor medium for delivery to the smoker. There is also provided a flavor cassette including a housing and a substantially non-combustible elongated tobacco flavor web within the housing. The tobacco flavor web has tobacco flavor medium therealong. The cassette further has means for supporting a section of the tobacco flavor web in thermal proximity to the electrical heating means, and means for advancing the tobacco flavor web past the supporting means for presenting the tobacco flavor medium to the electrical heating means.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which.

DETAILED DESCRIPTION OF THE INVENTION

I. Theory of the Invention

Figure 1:
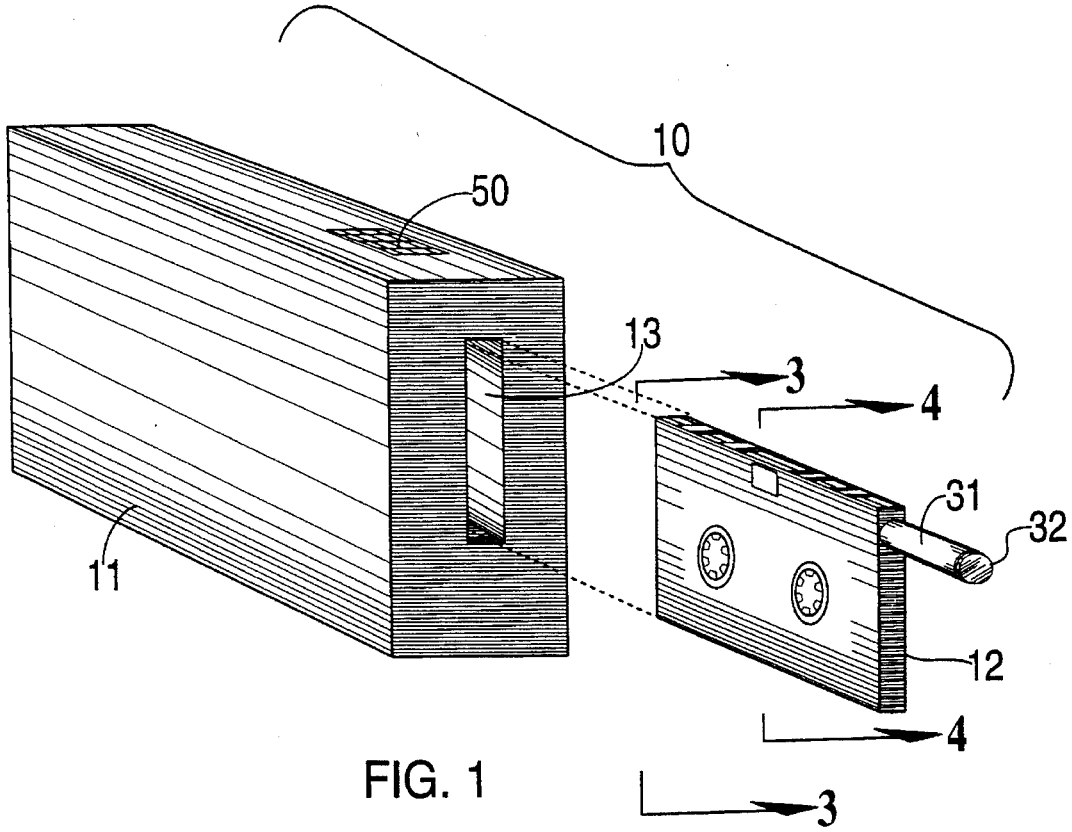
FIG. 1 is an exploded perspective view of a first preferred embodiment of an electrical smoking article according to the present invention.

The present invention provides an electrical smoking article for "all-day" use, by providing a substantially continuous flavor web, preferably in a cassette, that holds a relatively large number of portions of tobacco flavor medium. As a result, the smoker need not change the cassette that frequently—e.g., not more than once per day—which means, first, that use of the article is more convenient for the smoker; second, that there is less wear and tear on the interface elements of the permanent portion of the article; and third, that there is less waste to be disposed of from spent cassettes.

These results are preferably achieved by providing the tobacco flavor medium on a base web of a suitable material, which is preferably substantially non-combustible, although a web made of tobacco sheet without a base web can also be used. Suitable means is provided for advancing the web past a heater. A preferred base web material is a carbon fiber mat, which may be woven or non-woven, such as that described in copending, commonly-assigned U.S. patent application Ser. No. 07/943,747, filed Sep. 11, 1992 and hereby incorporated by reference in its entirety. A more particularly preferred base web material would be similar to that described in application Ser. No. 07/943,747, but would have all of its carbon fibers oriented substantially parallel to the long dimension of the web, to maximize tensile strength in that direction. In still another preferred embodiment, the web could be made from the tobacco flavor medium itself, preferably reinforced with carbon fibers, which most preferably would be continuous. Such a continuous-fiber reinforced web could be produced by casting the web as a continuous tobacco sheet using a papermaking-type process familiar to those skilled in the making of reconstituted tobacco products, with continuous carbon filaments laid down over the surface on which the sheet is cast.

In addition, the tobacco flavor web, whether or not including a base web, can be reinforced by longitudinal strips of a reinforcing material over less than the full width of the web. Suitable reinforcing materials include paper, metallic foils, and foil/paper laminates, as discussed in more detail below.

In a preferred embodiment, the flavor cassette resembles a tape cassette of the type used in microcassette tape recorders, with the web wound on a supply reel and attached to a take-up reel which rotates to advance the web as it is consumed. In one version of this embodiment, a heater is mounted in the cassette. For example, the heater may be mounted where the pressure pad of a microcassette tape would ordinarily be mounted. Electrical contacts on the outside of the cassette would mate with contacts in the permanent portion of the article to provide electrical power to the heater. In another version of this embodiment, the heater is mounted on the permanent portion of the article, and the cassette has an opening into which the heater protrudes in thermal proximity to the web.

An airflow passage is preferably provided in the cassette to allow air to be drawn past the heater. More preferably, the cassette is provided with a mouthpiece, for use by the smoker, that connects with the passageway and protrudes from the article when the cassette is inserted in the article. In one preferred embodiment, the mouthpiece is retractable, so that the cassette can be packaged and sold with the mouthpiece retracted. Most preferably, the mouthpiece, whether retractable or not, contains a filter that is preferably replaceable. An appropriate filter might be a conventional cellulose acetate filter plug of the type used in conventional cigarettes. The plug might be wrapped in tipping paper to give a familiar and pleasing appearance.

The web might carry a continuous layer of tobacco flavor medium, in which case the advancing means would preferably advance the web sufficiently far between puffs that no portion of the tobacco flavor medium that was previously heated is reheated. This would be the case particularly where the web is a cast tobacco sheet. Alternatively, the web might carry individual portions of tobacco flavor medium spaced sufficiently far apart to be thermally isolated from one another, so that when one portion is heated, adjacent portions are not heated, and as a result, no portion is ever reheated when it is used. In this alternative, the web should be advanced with sufficient accuracy that each portion is in proper registry with the heater when the heater is activated to generate tobacco flavor substance from that portion.

The "permanent" portion of the article might be the size and shape of a conventional cigarette pack, with a cavity for receiving the flavor cassette. Within the cavity would be the contacts described above for powering the heater, as well as capstans for mating with the hubs of the supply and take-up reels for advancing the tobacco flavor web. When the flavor cassette is in the cavity with its mouthpiece protruding, the electrical smoking article might have the familiar appearance of a conventional cigarette pack with one cigarette protruding from an open corner.

The cavity might be in the end of the permanent portion, and the cassette could be slid into the cavity endwise, with appropriate provisions for retracting the capstans as the cassette is inserted, as would be well known to one of ordinary skill in the art of cassette tape recorders. For example, the cassette could actuate a lever as it is inserted which moves the capstans aside, or which releases the capstans and allows them to be pushed aside. Alternatively, a door could be provided in the side of the permanent portion to allow the cassette to be loaded directly over the capstans in another arrangement familiar in cassette tape recorders.

It is also possible to provide a cassette in a configuration other than that of a conventional microcassette. Similarly, it is possible to provide a single reel of tobacco flavor web. In such a case, after the web is advanced past the heater, it could then exit the housing of the permanent portion to be torn off and discarded by the smoker, or it could be fed into a waste receptacle which might be periodically emptied by the smoker.

Also in the permanent portion would be the power source (e.g., a suitable battery or batteries), control circuitry and puff sensor described in above-incorporated U.S. Pat. Nos. 5,060,671 and 5,095,921. More particularly preferred embodiments of those components, for use in the article of the present invention, might be those of copending, commonly-assigned U.S. patent application Ser. No. 07/943,504, filed Sep. 11, 1992 and hereby incorporated by reference in its entirety.

The permanent portion could also contain a suitable motor for accurately driving the capstans. Stepper motors, which can be accurately advanced in small increments, are well known for use in applications requiring precision control of position, such as for computer disk drive head positioning. Alternatively, an ordinary DC motor with suitable reduction gearing can be used. The control circuitry described above would, in addition to firing the heater on detection of a puff by the smoker, also send a signal to the motor to advance the web after each portion is heated in preparation for the next puff. The web could instead be advanced on detection of a puff, before heating, but that is less preferable because the time needed to advance the web might result in a delay in delivery of tobacco flavor substance that would be unacceptable to the smoker. The control circuitry preferably also detects when the flavor cassette is spent, by, for example, sensing the inability of the motor to advance the web further, and also preferably indicates to the smoker through a suitable display the number of portions remaining on the web, or that the cassette is spent, as described in said above-incorporated patents and applications.

Alternatively, the web might be advanced by a mechanical linkage that is manually actuated by the smoker. For example, a trigger could be provided that, when fully depressed and released, advances the web a precise distance.

The amount by which the web must be advanced is a function of the thermal conductivity of the web material. The higher the thermal conductivity of the web, the more of adjacent areas of the web will be heated each time the heater is activated. The web must be advanced far enough that no portion of tobacco flavor medium is reheated. Otherwise, off tastes might result from the generation of undesired substances on reheating of a portion that previously had been inadvertently heated. Preferably, therefore, depending on the heater dimensions, the web must be advanced by between about 4 mm and about 10 mm, and that is the distance the advancing motor must advance. When individual flavor portions are provided, the flavor portions must be spaced far enough apart so that they are thermally isolated from one another—i.e., so that when a particular portion is being heated, adjacent portions are not also heated inadvertently. The distance that the web must be advanced is then a function of the separation on the web between portions of tobacco flavor medium. Preferably, therefore, each portion is separated from adjacent portions by between about 1 mm and about 4 mm, and that is the distance the advancing motor must advance.

When the web is advanced, care must be taken that the supply reel does not free-wheel, which might result in too much web being fed, or in the web having insufficient tension to make good thermal contact with the heater. To prevent such free-wheeling, and assure good thermal contact, a brake of suitable conventional construction can be supplied, acting on either the supply reel capstan, in which case the brake would be in the permanent portion of the article, or on the supply reel itself, in which case the brake would be in the cassette. If the brake is in the cassette, then it is replaced each time the cassette is replaced, which lessens the probability of brake failure. Preferably, however, the brake should be in the permanent portion to avoid the cost and complexity of providing a new brake mechanism in each cassette.

A suitable heater is preferably made from the carbonaceous material described in said above-incorporated patent application Ser. No. 07/943,504, or in either of copending, commonly-assigned U.S. patent applications Ser. Nos. 07/931,997 and 07/932,224, both filed Aug. 19, 1992 and both hereby incorporated by reference in their entirety. In another preferred embodiment, a silicon semiconductor material, such as that described in copending, commonly-assigned patent application Ser. No. 07/943,505, filed Sep. 11, 1992 and hereby incorporated by reference in its entirety, may be used for the heater. A more particularly preferred embodiment is a serpentine-shaped metallic heater. Preferred heater materials are (1) an alloy of about 75% nickel, about 16% chromium, about 4.5% aluminum, about 3% iron, and traces of yttrium, such as that sold by Haynes International, of Kokomo, Indiana, under the trademark HASTELLOY® or the trademark HAYNES 214®, (2) an alloy of about 51% nickel, about 24% chromium, about 14% tungsten, about 5% cobalt, about 3% iron, and about 2% molybdenum, such as that sold by Haynes International under the trademark HAYNES 230®, or (3) an alloy of about 80% nickel and about 20% chromium, such as that sold by Driver-Harris Co., of Harrison, N.J., under the trademark NICHROME®.

Although some of these heater materials may be too brittle for use in a blade heater arrangement of the type described above without risk of blade breakage, a single heater of the type contemplated herein can be supported sufficiently to substantially negate such risk. Most importantly, the heater can be supported at both ends, unlike a blade that is supported at only one end.

As an alternative to mounting the heater in the cassette, the heater could be mounted in the permanent portion of the article, with a suitable structure in the cassette provided to insure good contact between the web and the heater. This has the advantage that the heater can be wired directly to the power source, rather than connected by mating contacts that may be subject to unnecessary contact resistance. However, if a permanent heater is used, precautions should preferably be taken to isolate the heater from the tobacco flavor substance that is generated. Otherwise, the heater may be subject over the lifetime of the permanent portion of the article—which could be quite long if the power source is replaceable or rechargeable—to being fouled by the condensation of tobacco flavor substance. The resultant coating of tobacco flavor substance on the heater may reduce the heat transfer ability of the heater, and may also give rise to off tastes as the coating is reheated. In contrast, if the heater is changed with the cassette, those effects will be substantially avoided or reduced.

The heater should preferably reach a temperature of between about 400° C. and about 500° C. All of the heater materials referred to above are capable of reaching that temperature range. However, care should be taken that the surrounding materials can withstand those temperatures. The carbon fiber mat referred to above can withstand those temperatures. The material from which the housing of the cassette is made, which is usually plastic, must also be selected with those temperatures in mind, or suitable insulation between the heater and the housing must be provided.

Once the correct materials are chosen, the cassette can be manufactured easily, at relatively low cost, by well-known tape cassette manufacturing techniques. Substantially all that is necessary is to substitute the web material for conventional recording tape, and the heater for the pressure pad. It may also be desirable to adjust the web path to soften sharp turns which the tobacco flavor web might be too brittle to make, especially after being heated.

II. Preferred Embodiments

Figure 2:
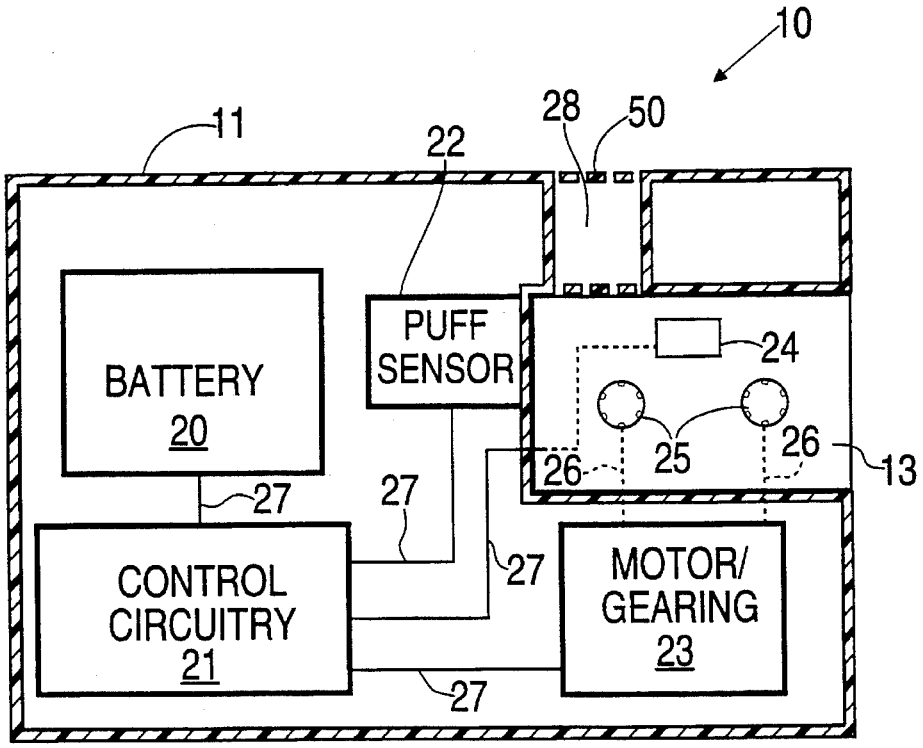
FIG. 2 is a cross-sectional view of the permanent portion of the electrical smoking article of FIG. 1, taken from line 2—2 of FIG. 1.
Figure 3:
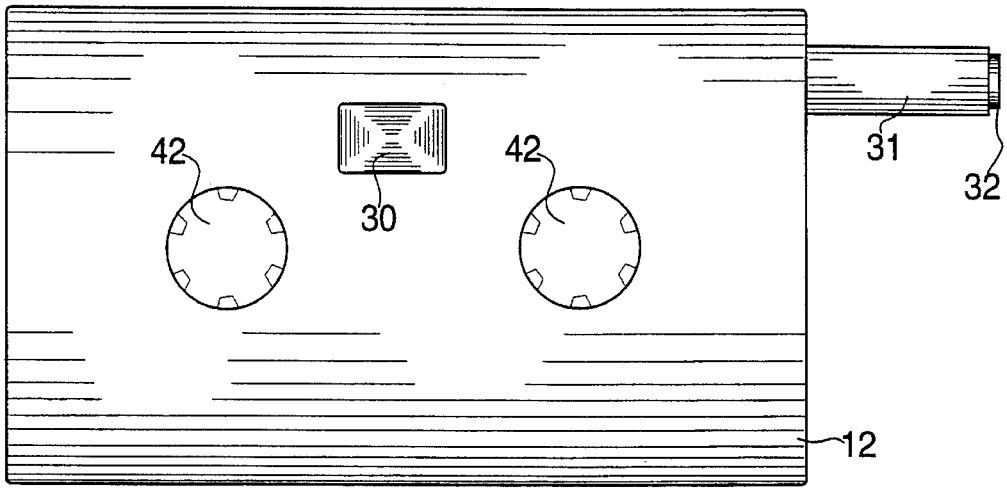
FIG. 3 is an elevational view of the flavor cassette of the article of FIG. 1, taken from line 3—3 of FIG. 1.
Figure 4:
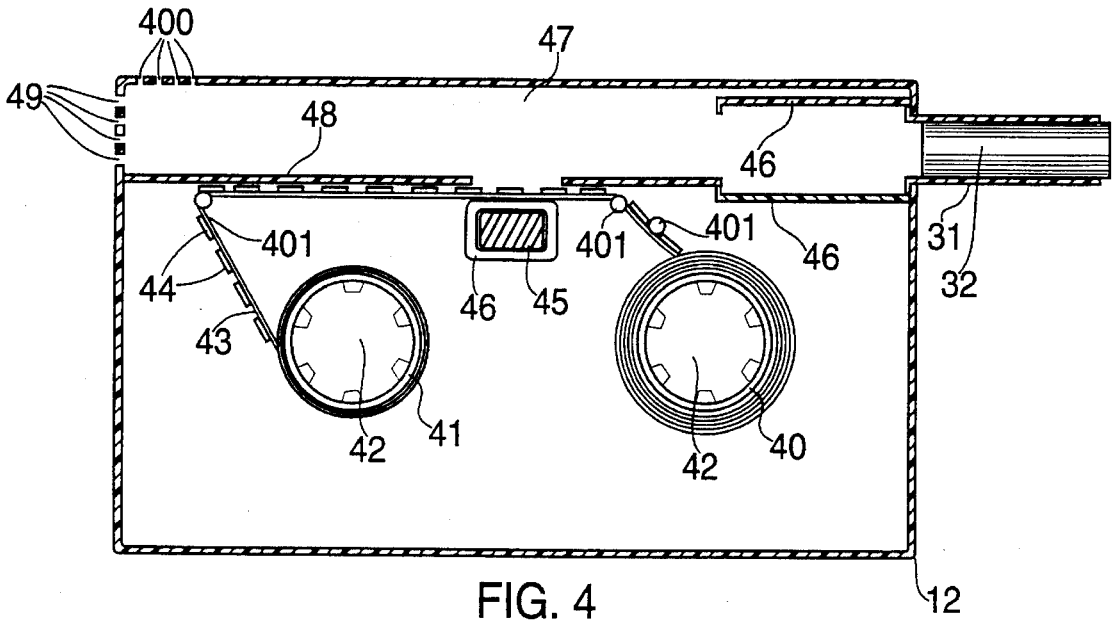
FIG. 4 is a cross-sectional view of the flavor cassette of the article of FIG. 1, taken from line 4—4 of FIG. 1.
Figure 5:
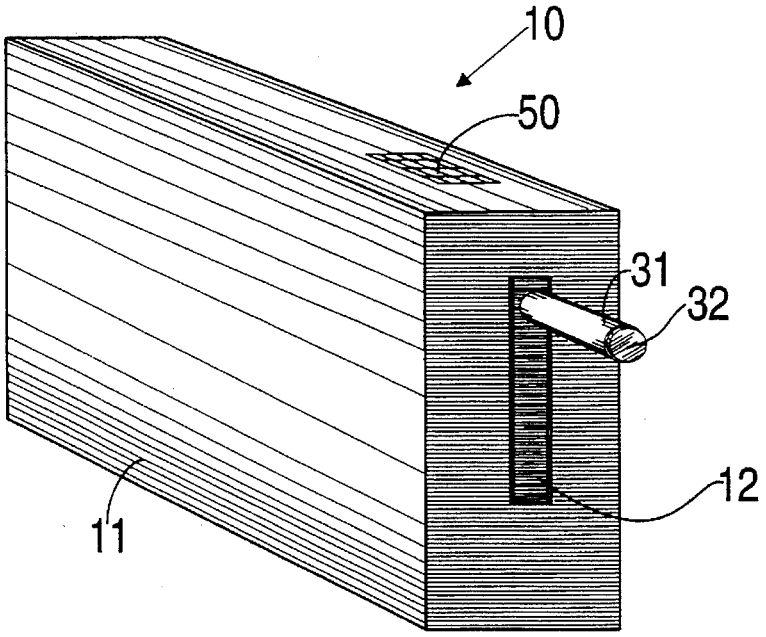
FIG. 5 is a perspective view of the electrical smoking article of FIGS. 1–4.

A first embodiment of an electrical smoking article according to the present invention is shown partially schematically in FIGS. 1–5. Electrical smoking article 10 includes permanent portion 11 and flavor cassette 12. Permanent portion 11 has cavity 13 for accepting cassette 12. Permanent portion 11 also has a battery or power source 20, control circuitry 21, puff sensor 22, and motor 23, all as described above. Within cavity 13, permanent portion 11 also has a pair of contacts 24 (one is shown in FIG. 2, and the other is in the opposite wall of cavity 13 that is cut away in FIG. 2) for delivering power to the heater in cassette 12, and a pair of capstans 25, such as conventional tape drive capstans, one or both of which are mechanically linked at 26 to motor 23. (If both capstans 25 are linked to motor 23, then motor 23 can serve as the brake referred to above.) As stated above, a suitable mechanical arrangement can be provided by one of ordinary skill in the art to allow capstans 25 to retract as cassette 12 is inserted in cavity 13, or a door (not shown) can be provided for insertion of cassette 12.

Power source 20, circuitry 21, sensor 22, motor 23 and contacts 24 are linked by suitable conductors 27.

As described above, cassette 12 has substantially the same outward appearance as an conventional recording tape microcassette, having supply reel 40 and take-up reel 41, each having a conventional hub 42 for mating with capstans 25. However, instead of recording tape, supply reel 40 carries web 43 as described above, bearing portions 44 of tobacco flavor medium, past heater 45. Heater 45 is supported at both ends by flanges 46 (one shown), one on each of the large walls of cassette 12. Contacts 30 on the outside of cassette 12 mate with contacts 24 in cavity 13.

Cassette 13 also has a mouthpiece 31 extending from one end. Preferably, mouthpiece 31 is retractable, with rails 46 guiding it and preventing it from being inserted so far into cassette 12 that it cannot be extended. For ease of packaging and shipment, cassette 13 is shipped with mouthpiece 31 retracted. Mouthpiece 31 also has filter 32, such as a conventional cellulose acetate cigarette filter.

Mouthpiece 31 is in fluid communication with airflow passage 47 in cassette 12. Airflow passage 47 is substantially isolated from the remainder of the interior of cassette 12 by wall 48, except where wall 48 is open over heater 45. When cassette 12 is inserted into cavity 13, airflow openings 49 communicate between airflow passage 47 and puff sensor 22, while airflow openings 400 communicate between airflow passage 47 and air tube 28 which connects to the outside air at screen 50.

Web 43 is maintained in suitable contact with heater 45 by appropriate braking (as discussed above) of supply reel 40, and by guide members 401 which assure that the path of web 43 is such that it contacts heater 45 at all times. Web 43 is loaded so that portions 44 are on the side of web 43 facing away from heater 45 and into passage 47.

When a smoker puffs on mouthpiece 31, puff sensor 22 detects the puff and causes control circuitry 21 to activate heater 45 for an appropriate predetermined period of time, evolving tobacco flavor substance from one of flavor portions 44 into passage 47, where the smoker draws it, along with outside air from tube 28, through filter 32 into the smoker's mouth. After heater 45 is de-energized at the end of the predetermined period, control circuitry 21 activates motor 23 to advance web 43.

Article 10 may have suitable indicators (e.g., on portion 11) to inform the smoker of the state of heater 45, of any lockout period that any be provided between puffs, and of the number of portions 44 remaining (or the end of web 43 having been reached), all as described in the above-incorporated patents and applications.

As stated above, cassette 12 can be loaded with a length of web 43 bearing a number of flavor portions 44 sufficient to provide a full day's use, or more. It is possible that filter 32 may become saturated or otherwise unusable before all of portions 44 are consumed. Accordingly, filter 32 may be made removable so that it can be replaced by the smoker more frequently than cassette 12.

"Permanent" portion 11 can be reused until power source 20 is depleted, and can then be discarded. Alternatively, power source 20 can be removable and replaceable, or rechargeable (either in or out of the article), all as described in said above-incorporated patents and applications, in which case portion 11 can be substantially truly permanent.

Figure 6:
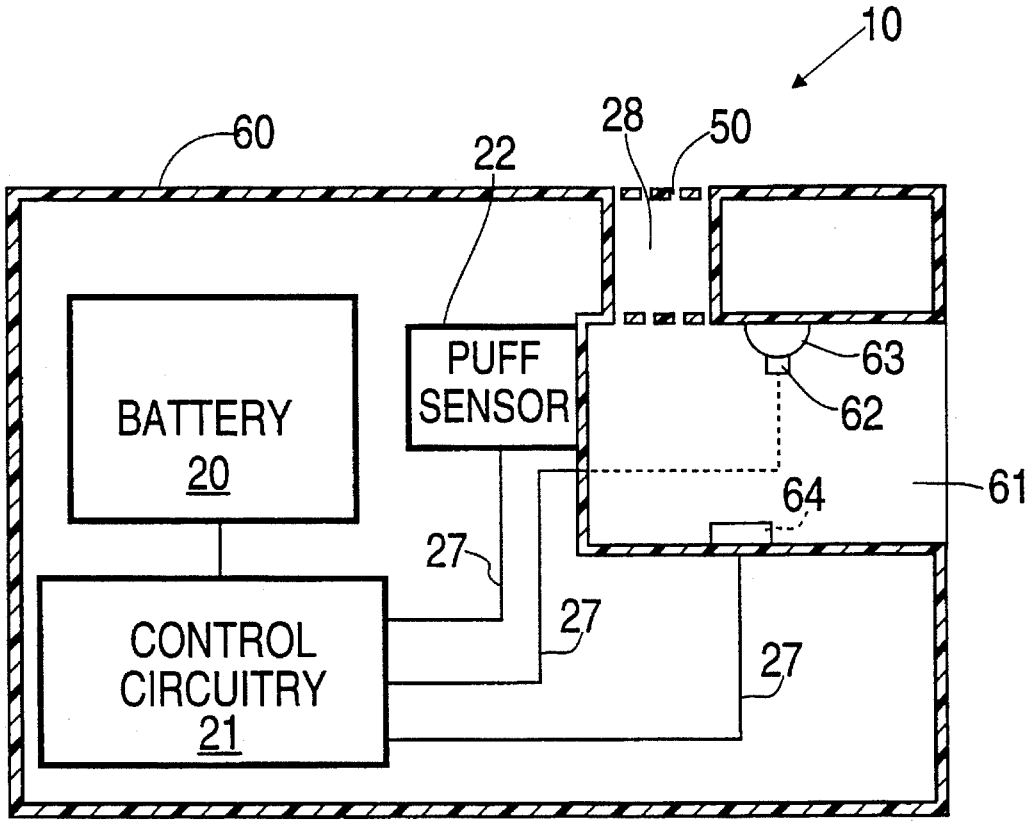
FIG. 6 is a cross-sectional view, similar to FIG. 2, of the permanent portion of a second preferred embodiment of an electrical smoking article according to the present invention.
Figure 7:
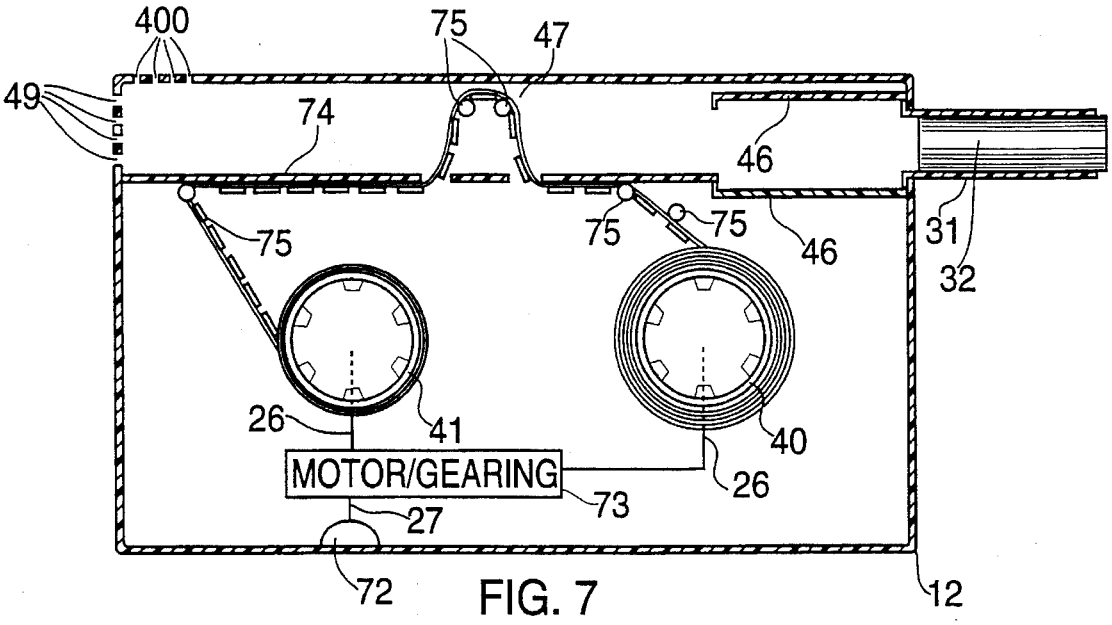
FIG. 7 is a cross-sectional view, similar to FIG. 4, of the flavor cassette of the second preferred embodiment of an electrical smoking article according to the present invention.

A second preferred embodiment of the invention is partially depicted in FIGS. 6 and 7, the remainder being identical to the embodiment of FIGS. 1–5. In this embodiment, permanent portion 60 has power source 20, circuitry 21 and sensor 22, as well as air tube 28, as in the first embodiment. However, cavity 61 differs from cavity 13 in that a heater 62 is mounted in the cavity. Preferably, heater 62 is mounted on a spring 63 for good contact with web 71 of cassette 70. Cavity 61 also has control contact 64 for mating with control contact 72 of cassette 70.

Cassette 70 has airflow passage 47 and mouthpiece 31 with filter 32, as above. However, in this embodiment, motor 73 is in the cassette, and is controlled via mating control contacts 64, 72. Further, wall 74 defining passage 47 differs from wall 48, having two openings for the passage of web 71, so that web 71 can be fed into passage 47 to contact heater 62 and then fed back out of passage 47 to take-up reel 41. Guide elements 75 provide the proper web transport path, assuring good contact between heater 62 and web 43. Finally, in this embodiment web 71 is loaded so that flavor portions 76 face inward, away from external heater 62 and into passage 47.

The operation of the embodiment of FIGS. 6 and 7 is functionally the same as that of the embodiment of FIGS. 1–5. In further embodiments (not shown), the heater can be in the cavity as in the second embodiment, while the motor is in the permanent portion as in the first embodiment, or the motor can be in the cassette as in the second embodiment, with the heater also in the cassette as in the first embodiment.

A third preferred embodiment 80, shown in FIGS. 8–11, differs mainly in the configuration of cassette 110. Cassette 110 is even closer than cassette 12 to a conventional recording tape cassette, to which a mouthpiece extension 111 has been added. In addition, a heater access port 112 has been cut in the sides of cassette 110. Cavity 90 of article 80, accessible under door 81 (shown in the closed position), is shaped to accommodate modified cassette 110. Like articles 10 and 60, article 80 has capstans 25 in cavity 90, as well as air passage 28 and opening 50 to allow outside air to be drawn in.

Heater 91 of article 80 is a serpentine-shaped metallic heater made of any suitable conductor of appropriate resistivity. A preferred material is the nickel-chromium-aluminum-iron-yttrium alloy described above and identified by the trademarks HAYNES 214® and HASTELLOY®. The other nickel-chromium-based alloys referred to above and identified by the trademarks Haynes 230® and NICHROME® may also be used. In addition, platinum-rhodium alloys can also be used.

Wire leads 27 electrically connected to power source 20 and control circuit 21 are attached, preferably by laser welding, to respective ends 102, 103 of heater 91. Ends 102, 103 are affixed to an insulating substrate 104 through which leads 27 pass, with heater 91 substantially perpendicular to substrate 104. Substrate 104 is in turn affixed to a ceramic support 105. Substrate 104 is preferably a polyetheretherketone (PEEK) polymer such as that sold by Imperial Chemical Industries, of Great Britain. Ceramic support 105 is preferably made from zirconia, alumina or titanium dioxide. Also affixed perpendicularly to substrate 104 and support 105 is a ceramic clamping block 92, preferably made from the same material as support 105. Clamping block 92 supports heater 91 at the top and the bottom, but central region 93 of clamping block 92 is preferably depressed to minimize conductive heat loss to clamping block 92. Preferably, the surface 106 of clamping block 92 in region 93 is coated with a gold layer 107 to reflect heat radiated by heater 91 back toward web 43.

Opening 112 is positioned directly adjacent the end of air passage 115 in mouthpiece extension 111, allowing the smoker to draw the tobacco flavor substance as soon as it is evolved at heater 91. A filter plug 32 is replaceably inserted into mouthpiece extension 111. Whereas in article 10 substantially all of filter plug 32 fit inside mouthpiece 31, in article 80 most of filter plug 32 is visible. Accordingly, it may be desirable to wrap plug 32 in a suitable tipping paper having a pleasing appearance, such as the familiar "cork" tipping paper used on some conventional cigarettes.

A port 116 in the side of mouthpiece extension 111 communicates between passage 115 and corresponding port 94 in the floor of cavity 90, which in turn communicates with puff sensor 100 (similar to puff sensor 22) under the floor of cavity 90. Motor 101 (similar to motor 23) is also located under the floor of cavity 90 for driving capstans 25 of article 80.

Constricted tube 117, preferably having a diameter between about 0.024 in. (about 0.609 mm) and about 0.032 in. (about 0.813 mm), provides a pressure drop or resistance-to-draw (RTD) for the smoker of between about 10 inches (about 254 mm) of water and about 0.4 inches (about 10 mm) of water, and preferably between about 6 inches (about 153 mm) of water and about 4 inches (about 100 mm) of water. Having tube 117 between heater 91 and port 116 allows the pressure sensing function to be separated from the body of cassette 110, and eliminates the need to seal the many openings in cassette 117 to maintain an adequate pressure drop.

Figure 12:
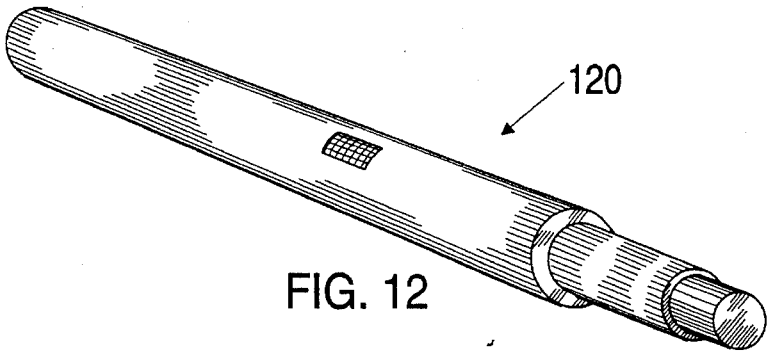
FIG. 12 is a perspective view of a fourth preferred embodiment of an electrical smoking article according to the present invention.
Figure 13:
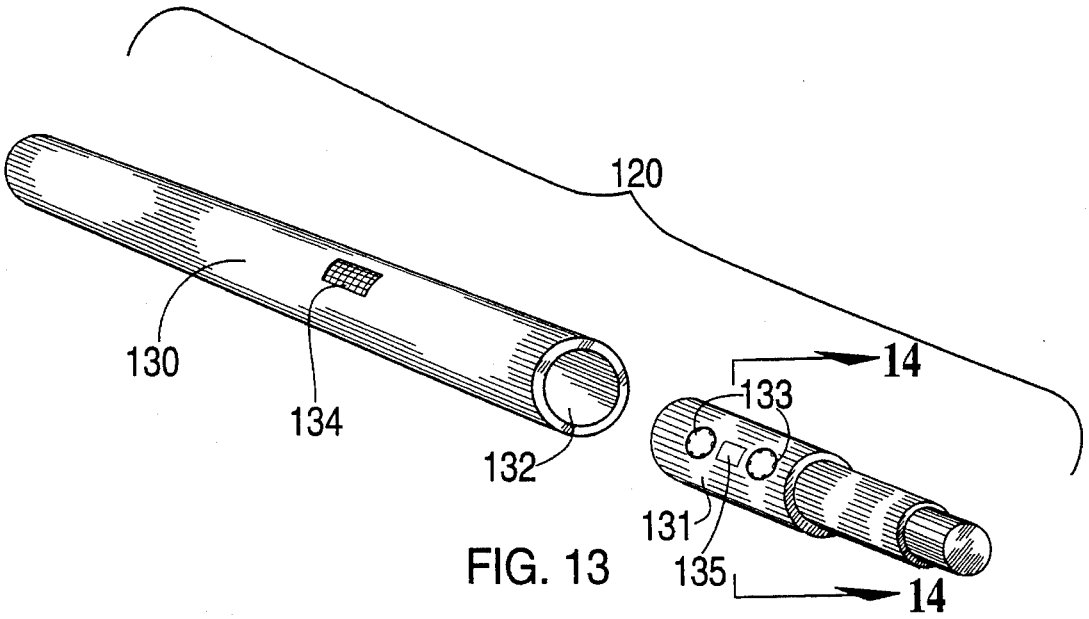
FIG. 13 is an exploded perspective view of the electrical smoking article of FIG. 12.
Figure 8:
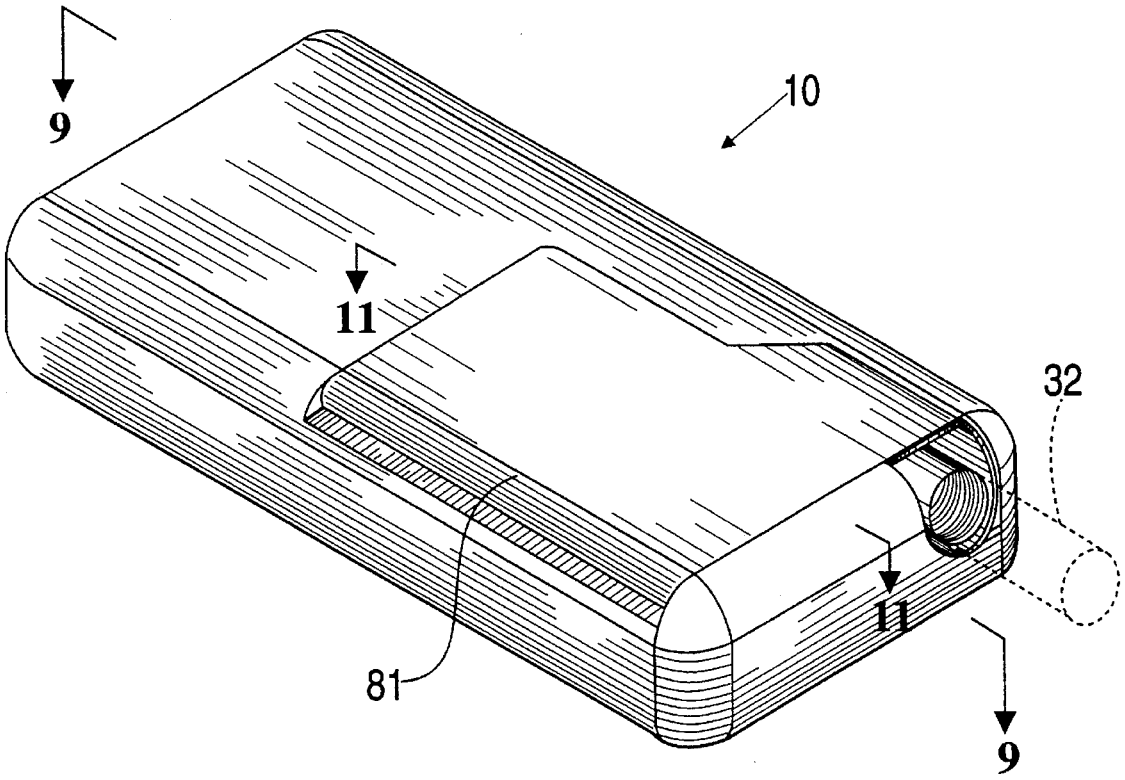
FIG. 8 is a perspective view of a third preferred embodiment of an electrical smoking article according to the present invention.
Figure 9:
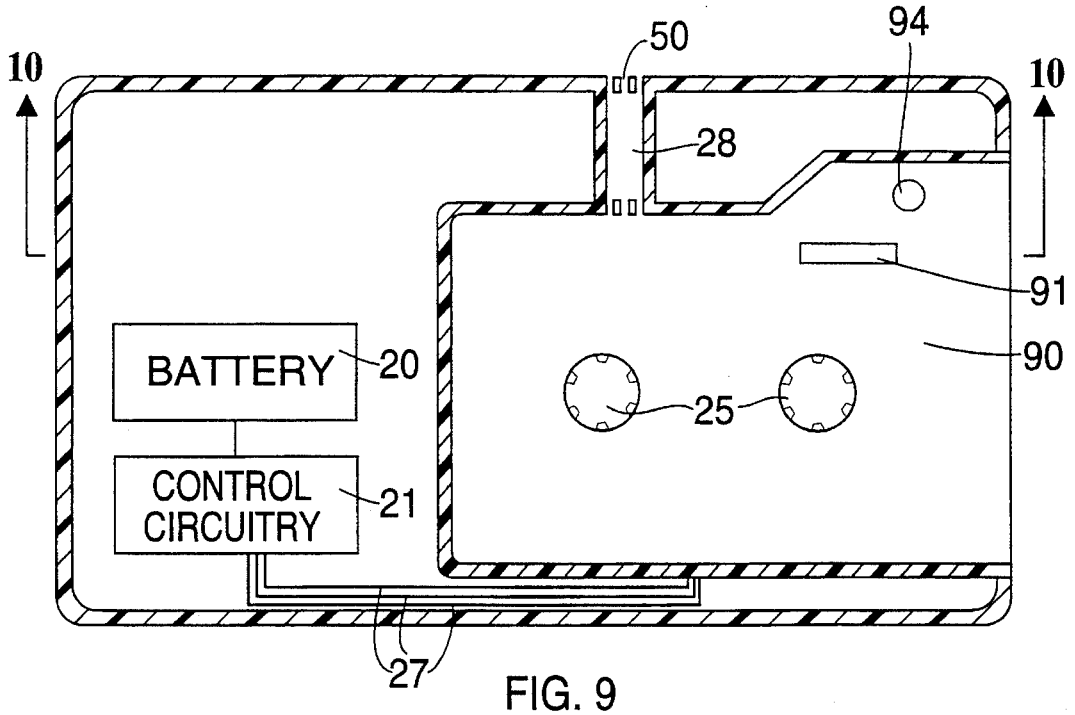
FIG. 9 is a cross-sectional view of the permanent portion of the electrical smoking article of FIG. 8, taken from line 9—9 of FIG. 8.
Figure 10:
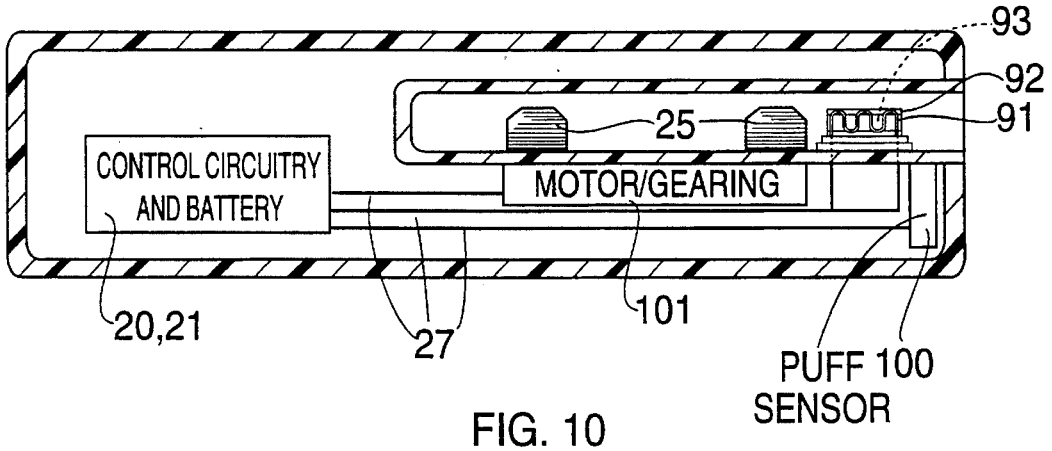
FIG. 10 is a cross-sectional view of the permanent portion of the electrical smoking article of FIGS. 8 and 9, taken from line 10—10 of FIG. 9.
Figure 10A:
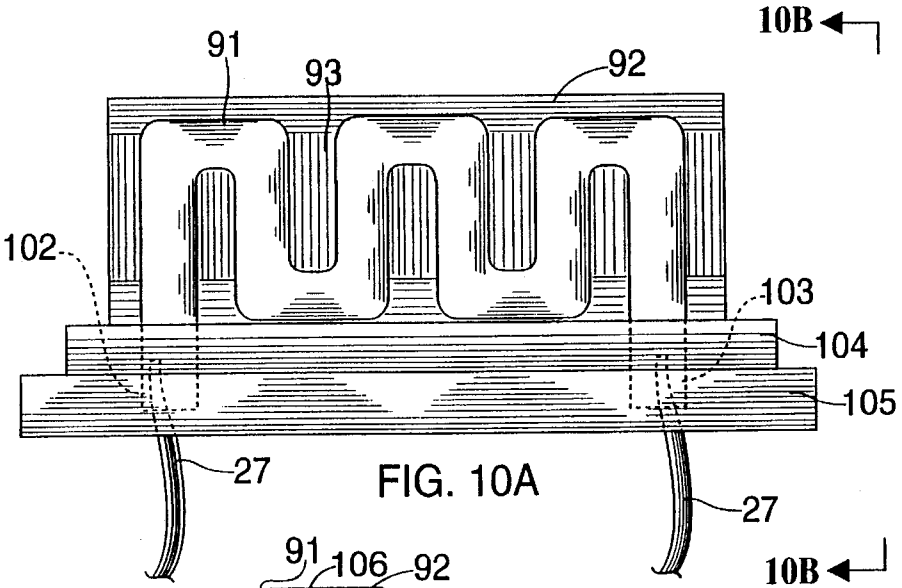
FIG. 10A is an enlarged elevational view of the heater assembly of the electrical smoking article of FIGS. 8–10.
Figure 10B:
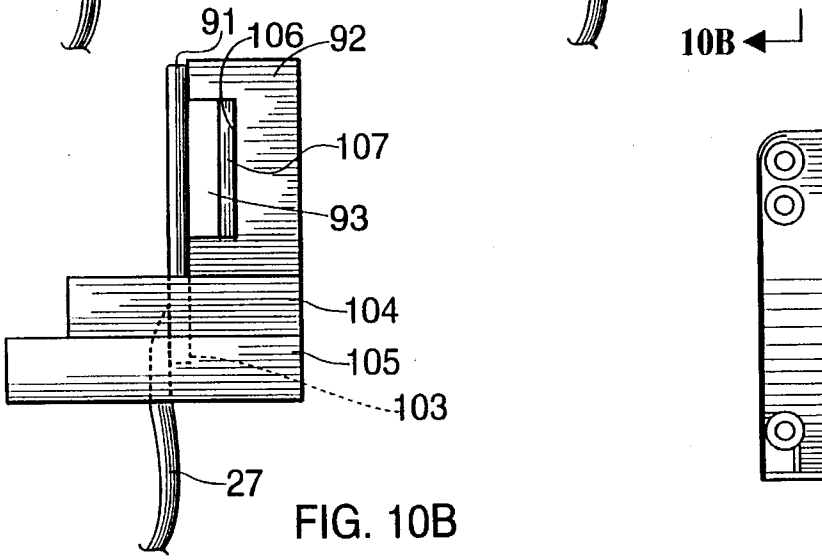
FIG. 10B is a side elevational view of the heater assembly of FIG. 10A, taken from line 10B—10B of FIG. 10A.
Figure 11:
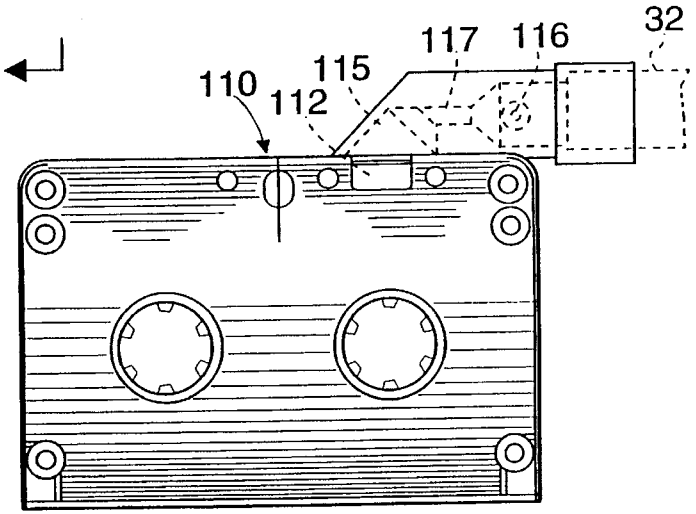
FIG. 11 is an elevational view of the flavor cassette of the electrical smoking article of FIGS. 8–10, taken from line 11—11 of FIG. 8.
Figure 14:
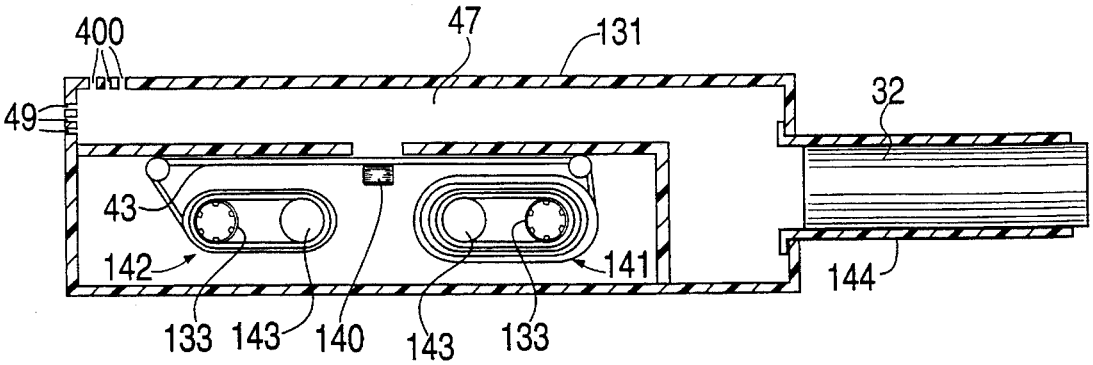
FIG. 14 is a cross-sectional view of a flavor cassette of the electrical smoking article of FIGS. 12 and 13, taken from line 14—14 of FIG. 13.

A fourth illustrated preferred embodiment, shown in FIGS. 12–14, has the shape of a conventional cigarette, although it likely has a greater diameter and a greater length. In this embodiment, article 120 has a permanent portion 130 and a flavor cassette 131. Permanent portion 130 is a substantially hollow cylinder, containing all the functional elements contained in permanent portion 11, above, but packaged into a cylindrical shape. Permanent portion 130 has a cavity 132 for insertion of cassette 131, and an air tube (not shown) similar to air tube 28, communicating between the outside air at screen 134 and airflow passage 47 of cassette 131 at openings 400 of cassette 131. Cavity 132 is similar, except in shape, to cavity 13, above, and similarly has contacts 24 (not shown in FIGS. 12–14) for energizing a heater 140 in cassette 131 via contacts 135 (one shown) on the exterior of cassette 131, as well as capstans 25 (not shown in FIGS. 12–14) for engaging hubs 133 of cassette 131. Indeed, although illustrated as cylindrical, both cassette 131 and cavity 132 could be rectangular.

Cassette 131 includes a supply of web 43 bearing tobacco flavor medium as in cassette 12. However, in order to accommodate a sufficient web supply in the smaller package of cassette 131, the reels of cassette 12 are replaced in cassette 131 by a pair of elongated belts 141, 142, which allow the web supply to be spread over the length of cassette 131 without unduly increasing the diameter of cassette 131. One end of each of supply belt 141 and take-up belt 142 runs over a respective one of hubs 133, while the other end of each of belts 141, 142 runs over a respective one of rollers 143. Cassette 131 preferably also has a preferably replaceable filter 31 in a mouthpiece 144. As depicted, cassette 131 does not have room for mouthpiece 144 to be retractable as is mouthpiece 31 of cassette 12; however, a retractable mouthpiece 144 may be provided in a suitable cassette of a type similar to cassette 131.

While in each of the four embodiments described above the web is advanced electrically, it is also possible for the web to be advanced by a manually-actuated mechanical linkage. A fifth preferred embodiment of the present invention, using such a linkage, is shown in FIGS. 15–20.

Article 150 is similar in shape to article 80, except that mouthpiece 151, into which filter plug 32 can be inserted, is at the center of one end rather than in a corner. A door 152 is provided for loading tobacco flavor web 160. An advancing lever 153 rides in a slot 154, and is biased (not shown) to the position in which it is shown in FIGS. 15–20.

When lever 153 is moved to the other end of slot 154, web 160 is fed from reel 161 past heater 91 as follows. Web 160 feeds between guide 164 and substantially square drive members 162, 163, and is advanced by the counterclockwise (as seen in FIGS. 15–20) rotation of members 162, 163 and the clockwise rotation of roller 165. When members 162, 163 are in the positions shown, web 160 is in contact with or very close to heater 91 for good thermal transfer. However, when members 162, 163 are rotated 45° from the positions shown, it can be seen that corners 166, 167 will hold web 160 near the upper trace 168 of guide 164, and away from heater 91. Thus, as web 160 is advanced, it does not drag against heater 91. This minimizes fouling of heater 91, and also decreases the chances for accidental breakage of web 160 that might occur if it rubbed against heater 91, particularly after web 160 had been weakened by heating.

Figure 17:
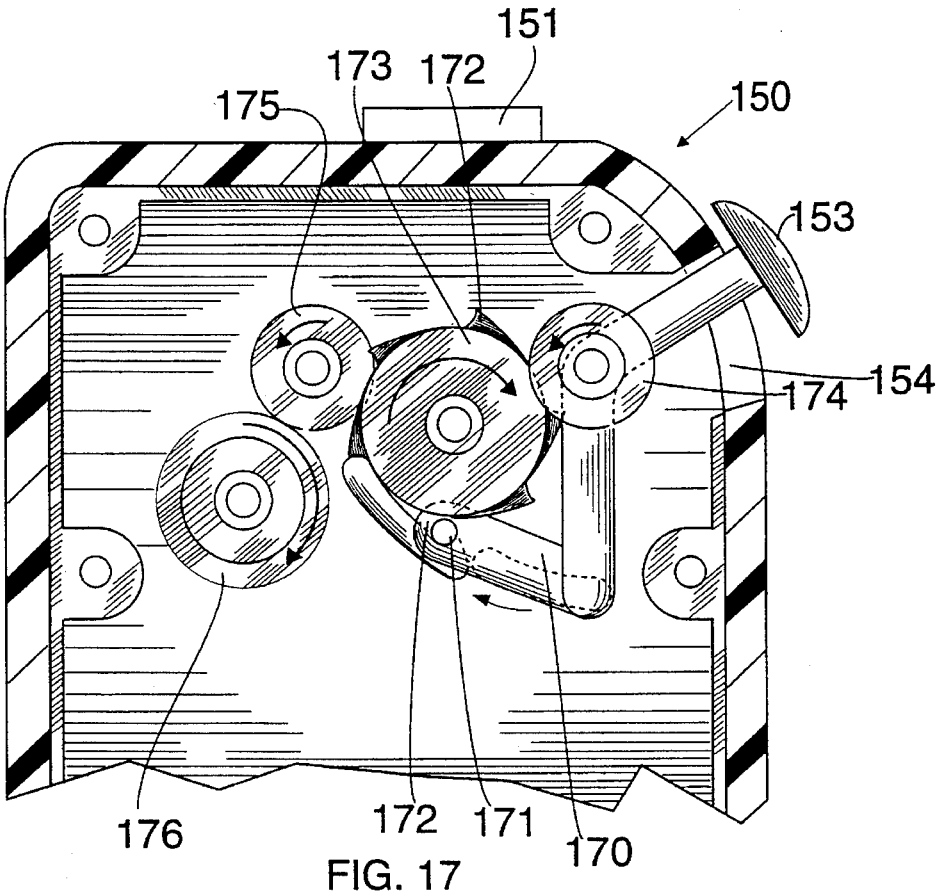
FIG. 17 is a fragmentary cross-sectional view of the electrical smoking article of FIGS. 15 and 16, taken from line 17—17 of FIG. 15.

The advancing of members 163, 164 and roller 165 is achieved by the mechanism shown in FIG. 17, which is actuated by lever 153. As lever 153 is depressed, it pushes arm 170 bearing pin 171 against ratchet teeth 172 of gear 173, rotating gear 173 clockwise. Gear 173 causes gears 174, 175, respectively journalled on common shafts with members 163, 164, to rotate counterclockwise, thereby rotating members 163, 164. At the same time, gear 175 causes gear 176 to rotate clockwise, thereby rotating roller 165 clockwise. The gear ratios are set so that members 163, 164 rotate exactly 90°, and the sizes of members 163, 164 are selected so that a 90° rotation advances web 160 the desired distance. When the cycle is complete and lever 153 is released, it returns under spring bias (not shown) to its original position. As lever 153 returns to position, pin 171 rides back over ratchet teeth 172 of gear 173 without causing rotation of gear 173.

Figure 15:
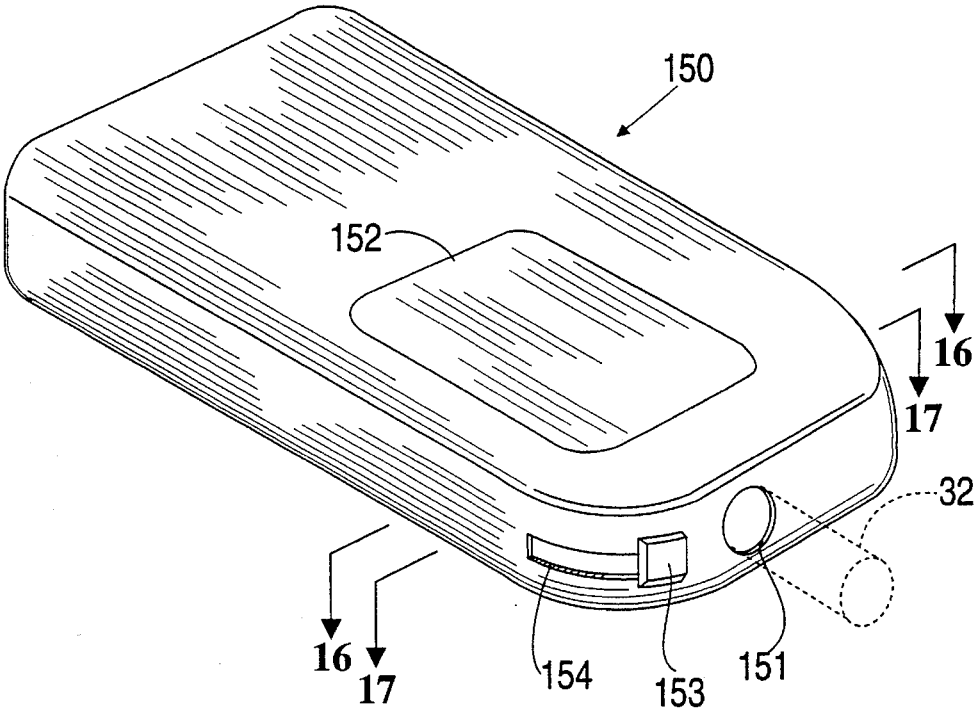
FIG. 15 is a perspective view of a fifth embodiment of an electrical smoking article according to the present invention.
Figure 16:
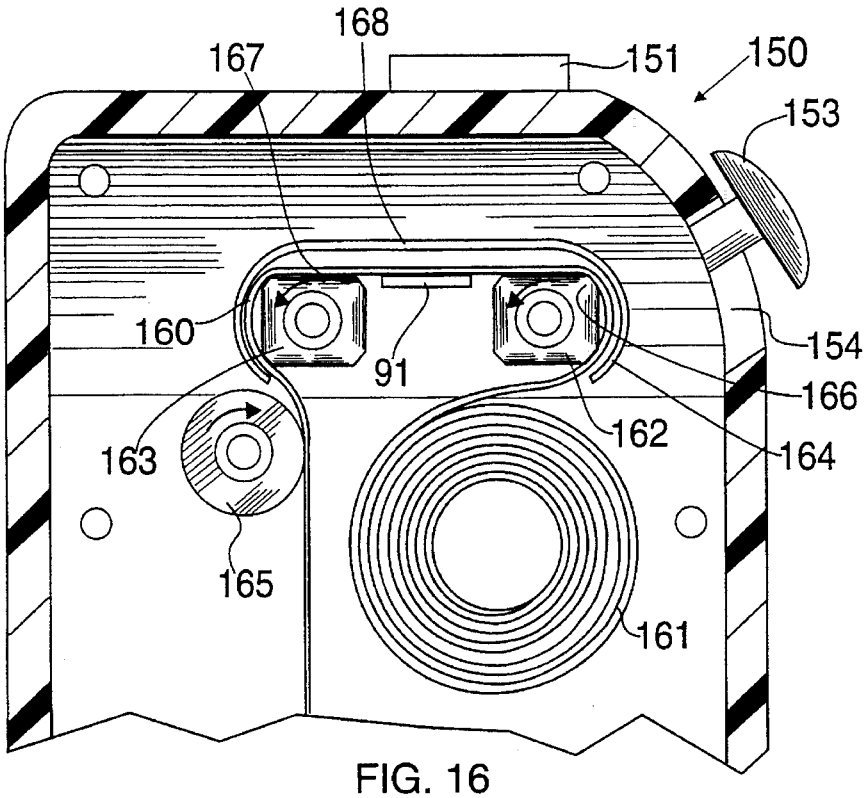
FIG. 16 is a fragmentary cross-sectional view of the electrical smoking article of FIG. 15, taken from line 16—16 of FIG. 15.
Figure 20:
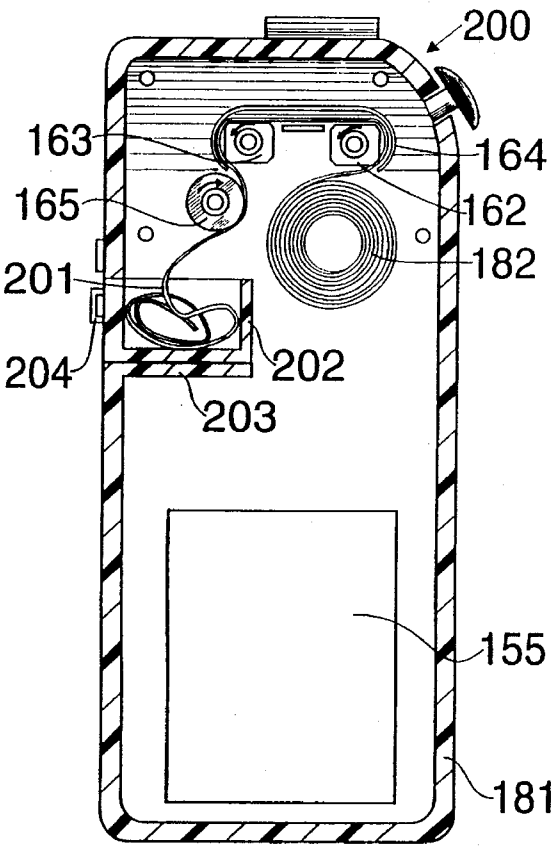
FIG. 20 is a cross-sectional view of a third alternative embodiment of the electrical smoking article of FIGS. 15–17.
Figure 19:
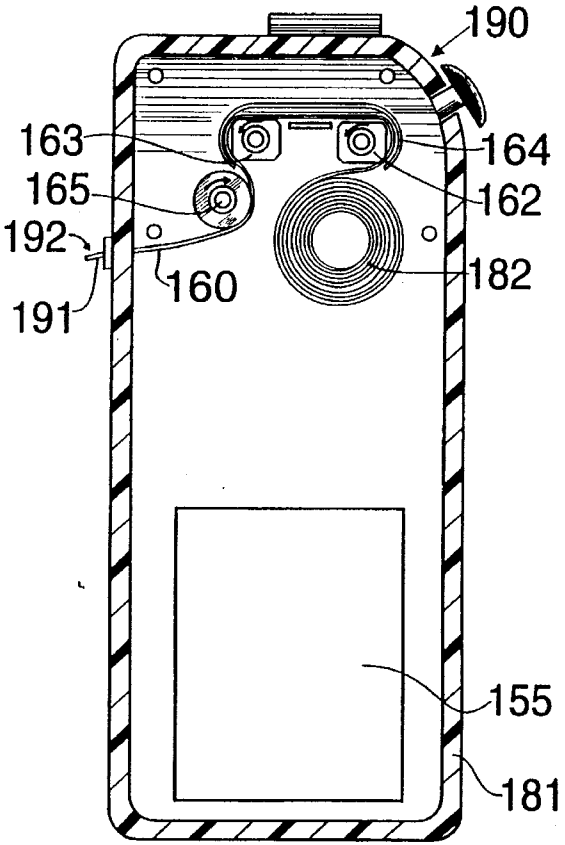
FIG. 19 is a cross-sectional view of a second alternative embodiment of the electrical smoking article of FIGS. 15–17.
Figure 18:
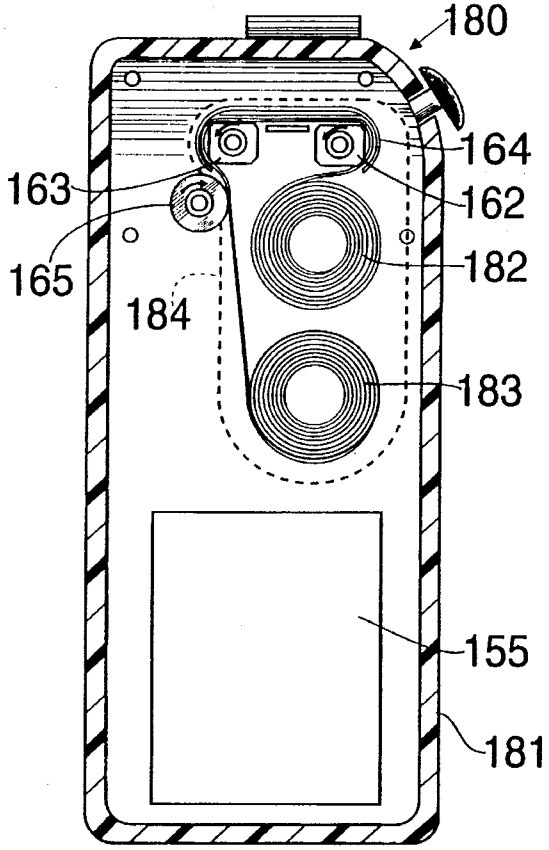
FIG. 18 is a cross-sectional view of a first alternative embodiment of the electrical smoking article of FIGS. 15–17.
Figure 21:
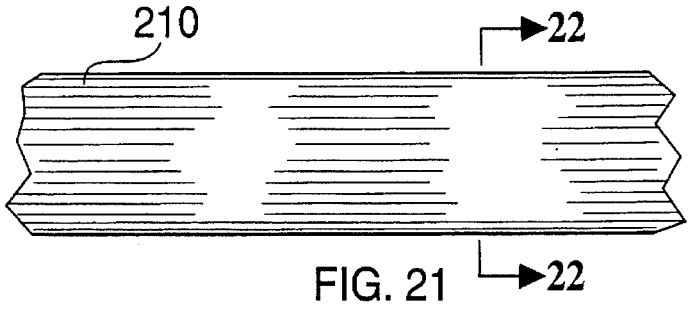
FIG. 21 is a plan view of a first preferred embodiment of a tobacco flavor web according to the present invention.

FIGS. 18–20 show three alternative embodiments of article 150, all of which use the manual advance system of FIGS. 15–17. In first alternative embodiment 180, shown in FIG. 18, power supply and control circuitry 155 is at the bottom of case 181. Tobacco flavor web 160 is supplied on a supply reel 182 and is taken up by a take-up reel 183. The two reels 182, 183 can be separate reels, or can be part of a cassette 184. Suitable means (not shown) can be provided to allow a smoker to thread web 160 around elements 162, 163 and between those elements and guide 164. Alternatively, and particularly if cassette 184 is provided, elements 162, 163, 164 can be provided as part of cassette 184, which would have openings (not shown) through which shafts in article 180 would engage elements 162, 163, 164. Reels 182, 183 (and possible elements 162, 163, 164) would all be replaced together through door 152.

In the second alternative embodiment 190 of article 150, web 160 is again provided on reel 182, but there is no take-up reel. Instead, the spent end 191 of web 160 is guided to slot 192 in case 181, where it exits. The protruding end 191 can then be torn off by the smoker and discarded.

In the third alternative embodiment 200 of article 150, web 160 is again provided on reel 182, and again there is no take-up reel. Here, the spent end 201 of web 160 is guided to receptacle 202 in case 181, where it accumulates. Receptacle 202, which rides on guide 203 (more than one guide 203 may be provided), can be removed for emptying by the smoker periodically using handle 204.

While in each of the illustrated embodiments the power source is an internally-contained battery (which may be replaceable or rechargeable), it may also be a capacitor. In such a case, charging contents would be provided on the surface of the article. Such contacts would also be provided if the power source were a rechargeable but non-removable battery. Finally, the power source of the article could be a connection for attaching to an external power supply. That connection may include suitable rectification or filtering means.

Figure 22:
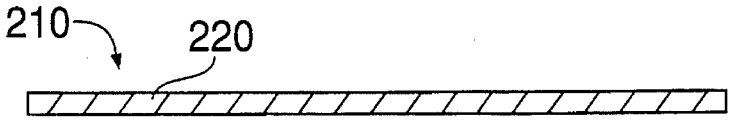
FIG. 22 is a cross-sectional view of the tobacco flavor web of FIG. 21, taken from line 22—22 of FIG. 21.
Figure 23:
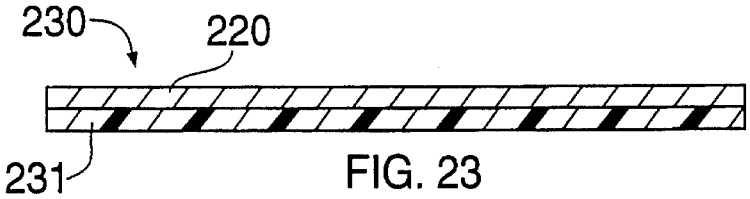
FIG. 23 is a cross-sectional view, similar to FIG. 22, of a first alternative embodiment of the tobacco flavor web of FIGS. 21 and 22.

A first preferred embodiment of the flavor web of the invention, in which the tobacco flavor medium is disposed continuously along the web 210, is shown in FIGS. 22–28. As shown in FIG. 22, the web 210 may be made of the tobacco flavor medium 220 itself, formed into an elongated sheet form by methods that are well known in, e.g., the manufacture of reconstituted tobacco products. Such an alternative may be sufficient in some applications, depending on the configuration of the path the web takes through the smoking article, and the amount of friction expected. If the configuration is such that an unsupported web may break, especially after heating when the web is weakened, then an alternative like that shown in FIG. 23 may be used. As shown in FIG. 23, web 230 is a laminate of tobacco flavor medium 220 and a support layer 231. Support layer 231 may be a woven or nonwoven carbon fiber mat as described above, for which suitable carbon fibers might be one-inch-long chopped carbon fibers available from Akzo Fortafil, Inc., of Rockwood, Tenn., a subsidiary of Akzo America, Inc., of Chicago, Ill., as FORTAFIL® 3C. Layer 231 may also be any other suitable material (e.g., suitably treated paper) that adds strength to layer 220 and can withstand the temperatures to which layer 220 will be heated without generating off tastes.

Figure 24:
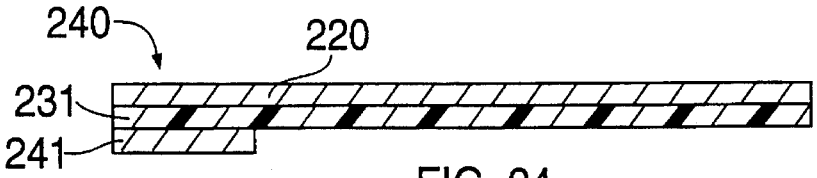
FIG. 24 is a cross-sectional view, similar to FIG. 22, of a second alternative embodiment of the tobacco flavor web of FIGS. 21 and 22.
Figure 25:
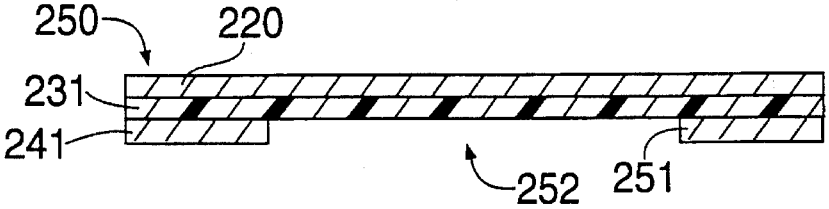
FIG. 25 is a cross-sectional view, similar to FIG. 22, of a third alternative embodiment of the tobacco flavor web of FIGS. 21 and 22.

It may be found that additional support is needed beyond that provided by support layer 231. As shown in FIG. 24, web 240 further includes reinforcing strip 241. Strip 241 may be paper, metallic foil, or a foil/paper laminate, and is disposed over only a portion of the edge of web 240 to avoid interfering with heat transfer between the heater and the web. As seen in FIG. 25, further support can be provided by a second reinforcing strip 251 similar to strip 241. If two reinforcing strips 241, 251 are used, web 250 might have to be slightly wider in order to present a sufficient unobstructed area 252 to the heater.

Figure 26:
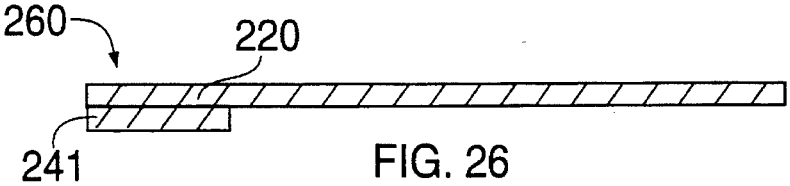
FIG. 26 is a cross-sectional view, similar to FIG. 22, of a fourth alternative embodiment of the tobacco flavor web of FIGS. 21 and 22.
Figure 27:
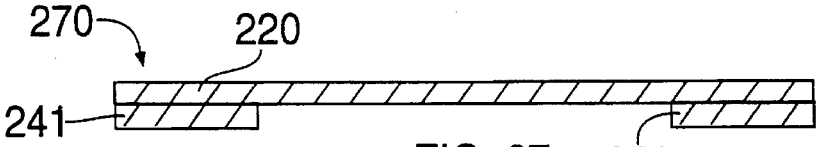
FIG. 27 is a cross-sectional view, similar to FIG. 22, of a fifth alternative embodiment of the tobacco flavor web of FIGS. 21 and 22.
Figure 28:
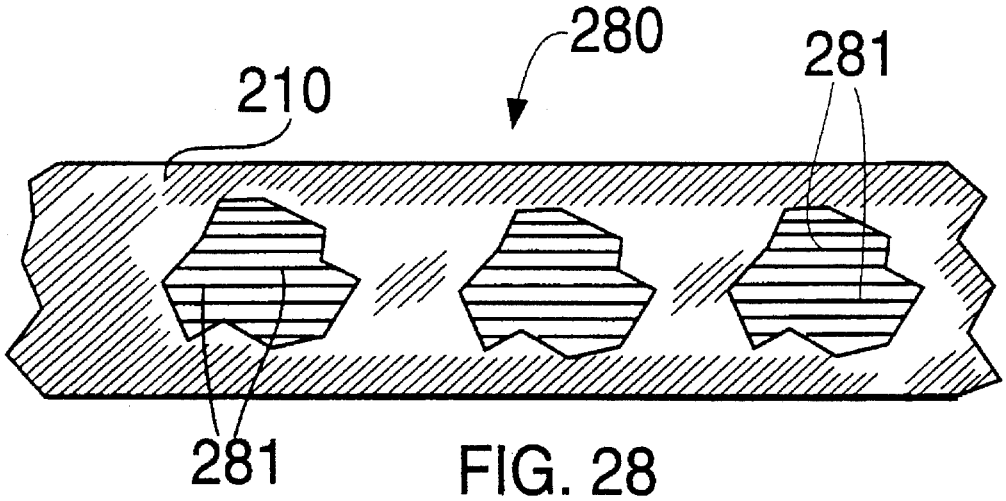
FIG. 28 is a partially fragmentary plan view of a sixth alternative embodiment of the tobacco flavor web of FIGS. 21 and 22.

In another alternative, it may be found that strip 241, or the combination of strips 241, 251 is sufficient to support continuous tobacco flavor medium strip 220, and two such alternatives 260, 270 are shown in FIGS. 26 and 27.

As a final alternative 280 of the first embodiment of the flavor web, continuous carbon fibers 281 can be embedded in layer 220 during its formation in the manner described above. Suitable continuous carbon fibers might be type IM6 carbon fibers from Hercules Corporation of Wilmington, Del.

Figure 29:
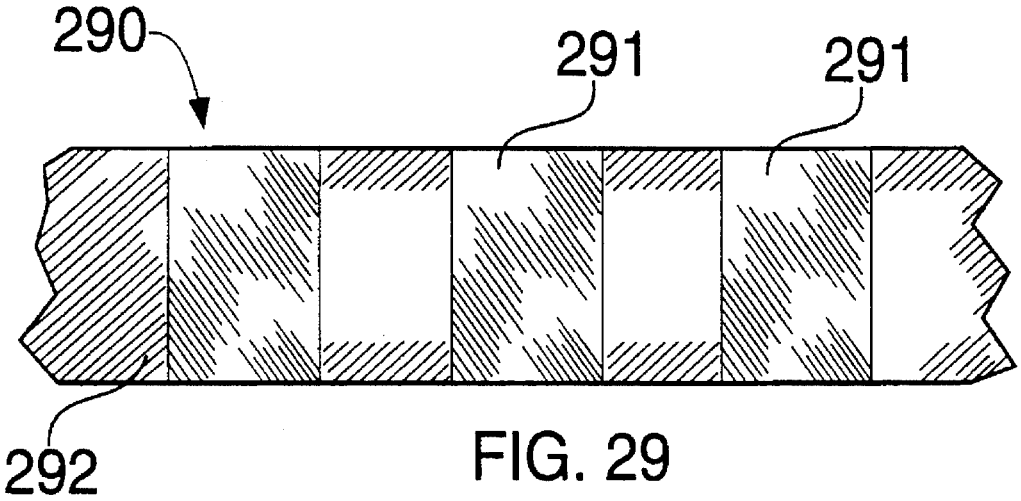
FIG. 29 is a plan view of a second preferred embodiment of a tobacco flavor web according to the present invention.

A second embodiment 290 of a flavor web according to this invention is shown in FIG. 29. In this embodiment, individual portions 291 of tobacco flavor medium 220 are deposited on a carrier web 292. Any of the alternative structures shown in FIGS. 23–25 can be used in this embodiment. As set forth above, this embodiment requires greater accuracy in web transport than the first embodiment, so that portions 291 are in registry with the heater. However, depending on the relative heat conductivities of the various web materials, both embodiments must be advanced approximately the same distance between puffs, as discussed above, to prevent reheating of tobacco flavor medium to avoid generation of off tastes.

Thus it is seen that an electrical smoking article, and replaceable flavor or heater/flavor unit therefor, which can provide a relatively large number of flavor portions, which reduces the wear on the permanent portion of the article, which reduces the volume of disposed of materials, and which increases the convenience for the smoker, has been provided. A replaceable flavor or heater/flavor unit for an electrical smoking article which can be manufactured easily and at relatively low cost has also been provided, as has an article incorporating such a unit. One skilled in the art will appreciate that the present invention can be practiced by other than the described embodiments, which are presented for purposes of illustration and not of limitation, and the present invention is limited only by the claims which follow.

What is claimed is:

1. An electrical smoking article for generating a tobacco flavor substance from a web having tobacco flavor medium therealong comprising:

a source of electrical energy;

electrical heating means;

means for supporting a section of the web in thermal proximity to said electrical heating means;

means for advancing the web to present a successive section of the web having the tobacco flavor medium therealong to said electrical heating means; and control means for applying electrical energy from said source of electrical energy to said electrical heating means for a predetermined period of time to generate a tobacco flavor substance from the section having tobacco flavor medium therealong for delivery to a smoker; and means for actuating said advancing means independently of applying electrical energy to said electrical heating means to present the successive section of the web to the electrical heating means.

2. The electrical smoking article of claim 1 further comprising a housing for said source of electrical energy, said supporting means, said advancing means and said control means.

3. The electrical smoking article of claim 2 wherein said housing is cylindrical.

4. The electrical smoking article of claim 1 wherein said means for advancing comprises means for exiting spent portions of said web after presentation to and heating by said electrical heating means.

5. The electrical smoking article of claim 1 further comprising a receptacle for receiving spent portions of said web after presentation to and heating by said electrical heating means.

6. The electrical smoking article of claim 5 further comprising means for removing said receptacle from said article.

7. The electrical smoking article of claim 1, wherein said actuating means actuates said advancing means at an end of the predetermined period of time of applying electrical energy to said electrical heating means.

8. The electrical smoking article of claim 1, wherein said actuating mean actuates said advancing means when said electrical heating means is de-energized.

9. The electrical smoking article of claim 1, wherein said actuating means actuates said advancing means when said electrical heating means is not heating the web.

10. The electrical smoking article of claim 1, wherein said advancing means advances a sufficient amount of web such that reheating of the flavor medium is avoided.

11. The electrical smoking article of claim 1 wherein said advancing means comprises:

means for holding a supply of said web before presentation to said electrical heating means; and means for holding spent portions of said web after presentation to and heating by said electrical heating means.

12. The electrical smoking article of claim 11 wherein:

said web supply holding means comprises a supply reel;

said spent portion holding means comprises a take-up reel; and said advancing means further comprises advancing means interface means for interfacing with said control means for causing at least one of said supply reel and said take-up reel to rotate.

13. The electrical smoking article of claim 12 further comprising means for maintaining tension on said web by retarding rotation of said supply reel as said take-up reel is caused to be rotated by said causing means and said web is advanced.

14. The electrical smoking article of claim 12 wherein said advancing means interface means comprises:

a spindle;

means for rotating said spindle; and a hub on said take-up reel for accepting said spindle.

15. The electrical smoking article of claim 12 wherein:

said advancing means comprises means for rotating said take-up reel; and said advancing means interface means comprises means for causing said rotating means to rotate.

16. The electrical smoking article of claim 15 wherein:

said rotating means is electrically operated; and said means for causing said rotating means to rotate comprises means for applying electrical energy to said rotating means.

17. The electrical smoking article of claim 11, wherein:

said web supply holding means comprises a supply reel;

said spent portion holding means comprises a take-up reel;

said advancing means comprises means for rotating said take-up reel, said rotating means being mechanically actuated and comprising:

a lever movable between first and second positions, and a ratchet wheel operatively connected to said take-up reel; and said lever causes said ratchet wheel to rotate as said lever is moved from said first position to said second position, said ratchet wheel remaining stationary as said lever returns from said second position to said second position.

18. The electrical smoking article of claim 17 wherein said advancing means also rotates said supply reel.

19. The electrical smoking article of claim 17 wherein said advancing means moves said web away from said heater as it advances said web.

20. The electrical smoking article of claim 19 wherein said advancing means moves said web back toward said heater on completion of advancing said web.

21. The electrical smoking article of claim 20 wherein:

said advancing means comprises a pair of substantially square advancing members operatively connected to said ratchet wheel and rotating together when said lever is moved from said first position to said second position;

when said lever is in said first position, said square advancing means rest in a position in which a side of one said square advancing means defines a first line with said heater and a respective side of the other of said square advancing means, said web resting along said sides and adjacent said heater; and when said lever is being moved from said first position to said second position, respective corners of said square advancing members define a second line that moves away from and then toward said first line, said web resting along said second line and being kept away from said heater while advancing.

22. The electrical smoking article of claim 11 wherein said web supply holding means comprises a supply belt and said spend portion holding means comprises a take-up belt, and said advancing means further comprises means for causing said supply belt to rotate.

23. The electrical smoking article of claim 20 further comprising airflow passage means through which air drawn by said smoker can flow over said web adjacent said electrical heating means for delivering said tobacco flavor substance to said smoker.

24. The electrical smoking article of claim 23 further comprising mouthpiece means in fluid communication with said airflow passage means through which said smoker draws air carrying said tobacco flavor substance.

25. The electrical smoking article of claim 24 wherein said mouthpiece means comprises filter means for filtering said air carrying said tobacco flavor substance.

26. The electrical smoking article of claim 25 wherein said filter means comprises a cellulose acetate filter plug.

27. The electrical smoking article of claim 25 wherein said filter means is replaceable.

28. The electrical smoking article of claim 24 wherein said mouthpiece means is retractable.

29. The electrical smoking article of claim 23 wherein said airflow passage comprises means for maintaining resistance-to-draw.

30. The electrical smoking article of claim 29 wherein said means for maintaining resistance-to-draw is downstream of said heater.

31. The electrical smoking article of claim 29 wherein said means for maintaining resistance-to-draw comprises a constriction of said airflow passage.

32. The electrical smoking article of claim 28 wherein said means for maintaining resistance-to-draw maintains resistance-to-draw between about 0.4 inches (about 10 mm) of water and about 10 inches (about 254 mm) of water.

33. The electrical smoking article of claim 32 wherein said means for maintaining resistance-to-draw maintains resistance-to-draw between about 4 inches (about 100 mm) of water and about 6 inches (about 153 mm) of water.

34. The electrical smoking article of claim 1 wherein said electrical heating means comprises a carbonaceous resistive material.

35. The electrical smoking article of claim 1 wherein said electrical heating means comprises a semiconductor material.

36. The electrical smoking article of claim 35 wherein said semiconductor material comprises silicon.

37. The electrical smoking article of claim 1 wherein said electrical heater means comprises a ceramic substrate.

38. The electrical smoking article of claim 37 wherein said ceramic substrate comprises zirconia.

39. The electrical smoking article of claim 37 wherein said ceramic substrate comprises alumina.

40. The electrical smoking article of claim 1 wherein said electrical heating means comprises a metal alloy.

41. The electrical smoking article of claim 40 wherein said metal alloy comprises nickel and chromium.

42. The electrical smoking article of claim 41 wherein said metal alloy comprises about 80% nickel and about 20% chromium.

43. The electrical smoking article of claim 41 wherein said metal alloy further comprises aluminum, iron and yttrium.

44. The electrical smoking article of claim 43 wherein said metal alloy comprises about 75% nickel, about 16% chromium, about 4.5% aluminum, about 3% iron and traces of yttrium.

45. The electrical smoking article of claim 41 wherein said metal alloy further comprises tungsten, cobalt, iron and molybdenum.

46. The electrical smoking article of claim 45 wherein said metal alloy comprises about 51% nickel, about 24% chromium, about 14% tungsten, about 5% cobalt, about 3% iron and about 2% molybdenum.

47. The electrical smoking article of claim 1 further comprising a removable cassette for housing said elongated web.

48. The electrical smoking article of claim 47 wherein:

said electrical heating means is in said cassette; and said cassette further comprises electrical heater contact means for connecting said electrical heating means to said source of electrical energy.

49. The electrical smoking article of claim 47 further comprising means for receiving said removable cassette.

50. The electrical smoking article of claim 49 wherein said means for receiving said removable cassette comprises:

a receptacle in said article corresponding in size and shape to said removable cassette; and means in said receptacle for interfacing between said web advancing means and said control means.

51. The electrical smoking article of claim 50 wherein said web advance interface means is electrical.

52. The electrical smoking article of claim 50 wherein said web advance interface means is mechanical.

53. The electrical smoking article of claim 49 wherein:

said electrical heating means is in said cassette; and said cassette further comprises electrical heater contact means for connecting said electrical heating means to said source of electrical energy; said article further comprising:

means in said receptacle for applying electrical energy from said source of electrical energy to said electrical heater contact means.

54. For use in an electrical smoking article having a source of electrical energy and control means for applying electrical energy from the source of electrical energy, a flavor cassette for interfacing with the electrical smoking article, the cassette comprising:

a housing;

a web within said housing, said web having tobacco flavor medium therealong;

electrical heating means within said housing and adapted to interface with the control means such that the control means applies electrical energy from the source of electrical energy to said electrical heating means;

means for supporting a section of said web within said housing in thermal proximity to said electrical heating means to generate a tobacco flavor substance from said tobacco flavor medium; and means for advancing said web within said housing to present a successive section of said web having said tobacco flavor medium therealong to said electrical heating means.

55. The flavor cassette of claim 54, wherein said housing is provided with an air inlet passage for communicating ambient air outside of the electrical smoking article to the supported section of web in thermal proximity with the electrical heating means and is provided with a delivery passage for communicating the generated tobacco flavor substance and air to a smoker upon drawing.

56. For use in an electrical smoking article having a source of electrical energy, electrical heating means, and control means for applying electrical energy from the source of electrical energy to the electrical heating means, a flavor cassette for interfacing with the electrical smoking article, the cassette comprising:

a housing;

a web within said housing, said web having tobacco flavor medium therealong;

means for supporting a section of said web within said housing in thermal proximity to the electrical heating means to generate a tobacco flavor substance from said tobacco flavor medium; and means for advancing said web within said housing to present a successive section of said web having said tobacco flavor medium therealong to the electrical heating means, wherein said housing is provided with an air inlet passage for communicating ambient air outside of the electrical smoking article to the supported section of web in thermal proximity with the electrical heating means and is provided with a delivery passage for communicating the generated tobacco flavor substance and air to a smoker upon drawing.

57. The flavor cassette of claim 56, wherein said advancing means comprises a pair of equal sided, rotatable advancing members, wherein said web rests on first corresponding sides of said pair of advancing members for presentation to the electrical heating means and wherein said web rests on a respective corner of each of said advancing members between the first side and an adjacent side as said advancing members rotate, wherein said web is held away from the electrical heating means during advancement of said web.

58. The flavor cassette of claim 56 wherein said advancing means comprises:

means for holding a supply of said web before presentation to said electrical heating means; and means for holding spent portions of said web after presentation to and heating by said electrical heating means.

59. The flavor cassette of claim 58 wherein:

said web supply holding means comprises a supply reel;

said spent portion holding means comprises a take-up reel; and said advancing means further comprises advancing means interface means for interfacing with said control means in said article for causing at least one of said supply reel and said take-up reel to rotate.

60. The flavor cassette of claim 59 further comprising means for maintaining tension on said web by retarding rotation of said supply reel as said take-up reel is caused to be rotated by said causing means and said web is advanced.

61. The flavor cassette of claim 59 wherein said advancing means interface means comprises a hub on said take-up reel for accepting a spindle from said article.

62. The flavor cassette of claim 59 wherein:

said advancing means comprises means for rotating said take-up reel; and said advancing means interface means comprises means for causing said rotating means to rotate.

63. The flavor cassette of claim 62 wherein:

said rotating means is electrically operated; and said means for causing said rotating means to rotate comprises rotating means contact means for applying electrical energy to said rotating means.

64. The flavor cassette of claim 58, wherein:

said web supply holding means comprises a supply reel;

said spent portion holding means comprises a take-up reel;

said advancing means comprises means for rotating said take-up reel, said rotating means being mechanically actuated and comprising:

a lever movable between first and second positions, and a ratchet wheel operatively connected to said take-up reel; and said lever causes said ratchet wheel to rotate as said lever is moved from said first position to said second position, said ratchet wheel remaining stationary as said lever returns from said second position to said second position.

65. The flavor cassette of claim 64 wherein said advancing means also rotates said supply reel.

66. The flavor cassette of claim 64 wherein said advancing means moves said web away from said heater as it advances said web.

67. The flavor cassette of claim 66 wherein said advancing means moves said web back toward said heater on completion of advancing said web.

68. The flavor cassette of claim 56, wherein said housing further defines an airflow passage through which additional ambient air drawn by the smoker is delivered to a puff sensor of the electrical smoking article which activates the control means to supply electrical energy to the electrical heating means in response to a sensed draw.

69. The flavor cassette of claim 68 wherein said airflow passage comprises means for maintaining resistance-to-draw.

70. The flavor cassette of claim 69 wherein said means for maintaining resistance-to-draw is downstream of said heater.

71. The flavor cassette of claim 69 wherein said means for maintaining resistance-to-draw comprises a constriction of said airflow passage.

72. The flavor cassette of claim 69 wherein said means for maintaining resistance-to-draw maintains resistance-to-draw between about 0.4 inches (about 10 mm) of water and about 10 inches (about 254 mm) of water.

73. The flavor cassette of claim 72 wherein said means for maintaining resistance-to-draw maintains resistance-to-draw between about 4 inches (about 100 mm) of water and about 6 inches (about 153 mm) of water.

74. The flavor cassette of claim 56 further comprising mouthpiece means in fluid communication with said delivery passage through which the smoker draws air carrying said tobacco flavor substance.

75. The flavor cassette of claim 74 wherein said mouthpiece means comprises filter means for filtering said air carrying said tobacco flavor substance.

76. The flavor cassette of claim 75 wherein said filter means comprises a cellulose acetate filter plug.

77. The flavor cassette of claim 75 wherein said filter means is replaceable.

78. The flavor cassette of claim 74 wherein said mouthpiece means is retractable.

79. The flavor cassette of claim 56 wherein said web further comprises a support layer for said tobacco flavor medium.

80. The flavor cassette of claim 79 wherein said tobacco flavor medium is distributed substantially continuously along said web.

81. The flavor cassette of claim 79 wherein said tobacco flavor medium is distributed in spaced-apart individual portions along said web.

82. The flavor cassette of claim 81 wherein said advancing means advances said web such that individual portions are in registry with said electrical heating means.

83. The flavor cassette of claim 79 wherein said support layer is substantially non-combustible.

84. The flavor cassette of claim 83 wherein said substantially non-combustible support layer web comprises a carbon fiber mat.

85. The flavor cassette of claim 84 wherein said carbon fiber mat comprises nonwoven carbon fibers.

86. The flavor cassette of claim 84 wherein said carbon fiber mat comprises woven carbon fibers.

87. The flavor cassette of claim 56 wherein said web comprises a reinforcing layer.

88. The flavor cassette of claim 87 wherein said reinforcing layer comprises a strip having a width less than the width of said web.

89. The flavor cassette of claim 88 wherein said strip is affixed along an edge of said web.

90. The flavor cassette of claim 88 wherein said reinforcing layer comprises two said strips.

91. The flavor cassette of claim 90 wherein each of said strip is affixed along an edge of said web.

92. The flavor cassette of claim 87 wherein said reinforcing layer comprises paper.

93. The flavor cassette of claim 87 wherein said reinforcing layer comprises a metallic foil.

94. The flavor cassette of claim 87 wherein said reinforcing layer comprises a laminate of paper and a metallic foil.

95. For use in an electrical smoking article having a source of electrical energy, electrical heating means and control means for applying electrical energy from the source of electrical energy to the electrical heating means, a tobacco flavor medium delivery system, said delivery system comprising:

a web having tobacco flavor medium therealong;

means for supporting a section of said web in thermal proximity to the electrical heating means; wherein the electrical heating means heats the section of said web to generate a tobacco flavor substance from said tobacco flavor medium for delivery to a smoker: and means for advancing said web to present a successive section having said tobacco flavor medium therealong to the electrical heating means.

96. The delivery system of claim 1 wherein said means for advancing comprises means for exiting spent portions of said web after presentation to and heating by said electrical heating means.

97. The delivery system of claim 1 further comprising a receptacle for receiving spent portions of said web after presentation to and heating by said electrical heating means.

98. The delivery system of claim 97 further comprising means for removing said receptacle from said article.

99. The delivery system of claim 1, further comprising means for actuating said advancing means independently of the application of electrical energy to the electrical heating means.

100. The delivery system of claim 99, wherein said actuating means actuates said advancing means at an end of a predetermined period of applying electrical energy from the source of electrical energy to the electrical heating means.

101. The delivery system of claim 99, wherein said actuating means actuates said advancing means when the electrical heating means is de-energized.

102. The delivery system of claim 99, wherein said actuating means actuates said advancing means when the electrical heating means is not heating the web.

103. The delivery system of claim 99, wherein said advancing means stationarily presents said section of said web having tobacco flavor medium to the electrical heating means.

104. The delivery system of claim 99, wherein said advancing means advances a sufficient amount of said web having tobacco flavor medium such that reheating of tobacco flavor medium is avoided.

105. The delivery system of claim 1 wherein said advancing means comprises:

means for holding a supply of said web before presentation to said electrical heating means; and means for holding spent portions of said web after presentation to and heating by said electrical heating means.

106. The delivery system of claim 105 wherein:

said web supply holding means comprises a supply reel;

said spent portion holding means comprises a take-up reel; and said advancing means further comprises advancing means interface means for interfacing with the control means in the article for causing at least one of said take-up reel and supply reel to rotate.

107. The delivery system of claim 106 further comprising means for maintaining tension on said web by retarding rotation of said supply reel as said take-up reel is caused to be rotated by said causing means and said web is advanced.

108. The delivery system of claim 106 wherein said advancing means interface means comprises a hub on said take-up reel for accepting a spindle from the article.

109. The delivery system of claim 106 wherein:

said advancing means comprises means for rotating said take-up reel; and said advancing means interface means comprises means for causing said rotating means to rotate.

110. The delivery system of claim 109 wherein:

said rotating means is electrically operated; and said means for causing said rotating means to rotate comprises rotating means contact means for applying electrical energy to said rotating means.

111. The delivery system of claim 105, wherein:

said web supply holding means comprises a supply reel;

said spent portion holding means comprise a take-up reel;

said advancing means comprises means for rotating said take-up reel, said rotating means being mechanically actuated and comprising:

a lever movable between first and second positions, and a ratchet wheel operatively connected to said take-up reel; and said lever causes said ratchet wheel to rotate as said lever is moved from said first position to said second position, said ratchet wheel remaining stationary as said lever returns from said second position to said first position.

112. The delivery system of claim 111 wherein said advancing means also rotates said supply reel.

113. The delivery system of claim 111 wherein said advancing means moves said web away from the electrical heating means as it advances said web.

114. The delivery system of claim 113 wherein said advancing means moves said web back toward the electrical heating means on completion of advancing said web.

115. The delivery system of claim 114 wherein:

said advancing means comprises a pair of substantially square advancing members operatively connected to said ratchet wheel and rotating together when said lever is moved from said first position to said second position;

when said lever is in said first position, said square advancing means rest in a position in which a side of one said square advancing means defines a first line with the electrical heating means and a respective side of the other of said square advancing means, said web resting along said sides and adjacent the electrical heating means; and when said lever is being moved from said first position to said second position, respective corners of said square advancing members define a second line that moves away from and then toward said first line, said web resting along said second line and being kept away from the electrical heating means while advancing.

116. The delivery system of claim 2 wherein said web supply holding means comprises a supply belt and said spent portion holding means comprises a take-up belt, and said advancing means further comprises means for causing said supply belt to rotate.

117. The delivery system of claim 95 further comprising a removable cassette for housing said web.

118. The delivery system of claim 117 wherein said cassette comprises:

said electrical heating means; and electrical heater contact means for connecting said electrical heating means to said source of electrical energy.

119. The delivery system of claim 1 further comprising an airflow inlet passage through which ambient air drawn by the smoker can flow over said web adjacent the electrical heating means for delivering said tobacco flavor substance to the smoker.

120. The delivery system of claim 119 further comprising a mouthpiece means in fluid communication with said airflow inlet passage means through which the smoker draws air carrying said tobacco flavor substance.

121. The delivery system of claim 120 wherein said mouthpiece means comprises filter means for filtering said air carrying said tobacco flavor substance.

122. The delivery system of claim 121 wherein said filter means comprises a cellulose acetate filter plug.

123. The delivery system of claim 121 wherein said filter means is replaceable.

124. The delivery system of claim 121 wherein said mouthpiece means is retractable.

125. The delivery system of claim 119 wherein said airflow passage comprises means for maintaining resistance-to-draw.

126. The delivery system of claim 125 wherein said means for maintaining resistance-to-draw is downstream of the electrical heating means.

127. The delivery system of claim 125 wherein said means for maintaining resistance-to-draw comprises a constriction of said airflow passage.

128. The delivery system of claim 125 wherein said means for maintaining resistance-to-draw maintains resistance-to-draw between about 0.4 inches (about 10 mm) of water and about 10 inches (about 254 mm) of water.

129. The delivery system of claim 128 wherein said means for maintaining resistance-to-draw maintains resistance-to-draw between about 4 inches (about 100 mm) of water and about 6 inches (about 153 mm) of water.

130. The delivery system of claim 1 wherein said web further comprises a support layer for said tobacco flavor medium.

131. The delivery system of claim 130 wherein said tobacco flavor medium is distributed substantially continuously along said web.

132. The delivery system of claim 130 wherein said tobacco flavor medium is distributed in spaced-apart individual portions along said web.

133. The delivery system of claim 132 wherein said advancing means advances said web such that said individual portions are in registry with the electrical heating means.

134. The delivery system of claim 130 wherein said support layer is substantially non-combustible.

135. The delivery system of claim 134 wherein said support layer comprises a carbon fiber mat.

136. The delivery system of claim 135 wherein said carbon fiber mat comprises nonwoven carbon fibers.

137. The delivery system of claim 135 wherein said carbon fiber mat comprises woven carbon fibers.

138. The delivery system of claim 1 wherein said web comprises a reinforcing layer.

139. The delivery system of claim 138 wherein said reinforcing layer comprises a strip having a width less than the width of said web.

140. The delivery system of claim 139 wherein said strip is affixed along an edge of said web.

141. The delivery system of claim 138 wherein said reinforcing layer comprises two said strips.

142. The delivery system of claim 141 wherein each of said strip is affixed along an edge of said web.

143. The delivery system of claim 138 wherein said reinforcing layer comprises paper.

144. The delivery system of claim 138 wherein said reinforcing layer comprises a metallic foil.

145. The delivery system of claim 138 wherein said reinforcing layer comprises a laminate of paper and a metallic foil.

* * * * *